US006157360A

United States Patent [19]

Jeong et al.

[11] Patent Number: 6,157,360

[45] Date of Patent: Dec. 5, 2000

[54] SYSTEM AND METHOD FOR DRIVING COLUMNS OF AN ACTIVE MATRIX DISPLAY

[75] Inventors: Deog-Kyoon Jeong, Kyungki-do, Rep. of Korea; Gyudong Kim, Sunnyvale, Calif.; Ho Young Song, KyongGi Do, Rep. of Korea; David D. Lee, Palo Alto, Calif.

[73] Assignee: Silicon Image, Inc., Sunnyvale, Calif.

[21] Appl. No.: 08/815,486

[22] Filed: Mar. 11, 1997

[51] Int. Cl.[7] ..... G09G 3/36

[52] U.S. Cl. ..... 345/98; 345/87; 345/211

[58] Field of Search ..... 345/55, 98, 100, 345/206, 211, 89, 94, 204, 76; 341/144, 145, 133, 118, 150, 148, 156, 154; 327/277, 276; 361/86, 90; 348/657, 790, 673

[56] References Cited

U.S. PATENT DOCUMENTS

| | | | |
|---|---|---|---|
| 3,699,464 | 10/1972 | Zobel | 330/12 |
| 4,194,166 | 3/1980 | Sakai et al. | 330/257 |
| 4,340,904 | 7/1982 | Wingrove, Jr. | 348/657 |
| 4,462,021 | 7/1984 | Watanabe et al. | 341/118 |
| 4,511,881 | 4/1985 | Adam | 340/347 |
| 4,736,137 | 4/1988 | Ohwada et al. | 345/76 |
| 4,748,444 | 5/1988 | Arai | 340/784 |
| 4,772,100 | 9/1988 | Suenaga | 350/336 |
| 4,838,654 | 6/1989 | Hamaguchi et al. | 350/333 |
| 4,868,459 | 9/1989 | Dennerlein et al. | 315/158 |
| 4,897,656 | 1/1990 | van de Plassche et al. | 341/156 |
| 4,918,562 | 4/1990 | Pulizzi et al. | 361/86 |
| 5,051,739 | 9/1991 | Hayashida et al. | 340/784 |
| 5,061,920 | 10/1991 | Nelson | 340/784 |
| 5,243,333 | 9/1993 | Shiba et al. | 345/100 |
| 5,250,931 | 10/1993 | Misawa et al. | 345/206 |
| 5,250,937 | 10/1993 | Kikuo et al. | 345/89 |
| 5,355,038 | 10/1994 | Hui | 327/277 |
| 5,426,447 | 6/1995 | Lee | 345/103 |
| 5,436,745 | 7/1995 | Voisin et al. | 359/88 |
| 5,455,534 | 10/1995 | Motegi et al. | 327/544 |
| 5,469,164 | 11/1995 | Kemp | 341/145 |
| 5,510,807 | 4/1996 | Lee et al. | 345/103 |
| 5,526,014 | 6/1996 | Shiba et al. | 345/96 |
| 5,546,055 | 8/1996 | Klughart | 331/175 |
| 5,546,102 | 8/1996 | Scheffer et al. | 345/100 |
| 5,572,211 | 11/1996 | Erhart et al. | 341/144 |
| 5,574,475 | 11/1996 | Callahan, Jr. et al. | 345/100 |
| 5,604,511 | 2/1997 | Ohi | 345/98 |
| 5,623,277 | 4/1997 | Lippmann et al. | 345/87 |
| 5,650,801 | 7/1997 | Higashi | 345/210 |
| 5,675,352 | 10/1997 | Rich et al. | 345/89 |
| 5,693,237 | 12/1997 | Bodensohn | 261/23 |
| 5,708,434 | 1/1998 | Hasegawa | 341/148 |
| 5,854,627 | 12/1998 | Kurihara et al. | 345/89 |

FOREIGN PATENT DOCUMENTS

| | | | |
|---|---|---|---|
| 0 391 655 A2 | 10/1990 | European Pat. Off. | G09G 3/36 |
| 0 457 329 | 11/1991 | European Pat. Off. | G09G 3/36 |
| 0 720 140 A2 | 12/1995 | European Pat. Off. | G09G 3/36 |
| 44 46 330 A1 | 7/1995 | Germany . | |
| 2 136 622 | 9/1984 | United Kingdom | G09G 3/20 |
| WO 96/18990 | 6/1996 | WIPO | G09G 3/36 |

OTHER PUBLICATIONS

Fluxman, S. M. "Integrated Active Matrix Liquid Crystal Displays"; The GEC Journal of Research; vol. 11, No. 1; pp. 2–11, 1993.

Okada, H. et al.; "23.1: An 8–bit Digital Data Driver for AMLCDs", SID 94 Digest; 1994; pp. 347–350.

*Primary Examiner*—Dennis-Doon Chow

*Attorney, Agent, or Firm*—Fenwick & West LLP

[57] ABSTRACT

Described is a system and method for driving columns of an active matrix display using a resistor-string digital-to-analog converter (DAC). The description includes an auto-stop buffer circuit that drives an analog data voltage in two steps—the first step being active buffering by a "dead-zone amplifier" before the output reaches a certain level and the second step being acting as a passive conduit after the output reaches the certain level. The dead-zone amplifier inherently turns itself off when the analog voltage reaches the certain level. Also described are various column driver architectures in which buffers are placed in various ways in a column driver in between the resistor-string DAC and the column decoders in order to minimize the number of required buffers.

8 Claims, 20 Drawing Sheets

FIRST AUTO-STOP BUFFER CIRCUIT 500

BASIC STRUCTURE OF COLUMN DRIVER 100

FIG. 2 (Prior Art) DIRECT DRIVE SYSTEM 200

TIMED BUFFER CIRCUIT 400

FIRST AUTO-STOP BUFFER CIRCUIT 500

DEAD-ZONE AMPLIFIER 502

DIFFERENTIAL AMPLIFIER A 510

DIFFERENTIAL AMPLIFIER B 512

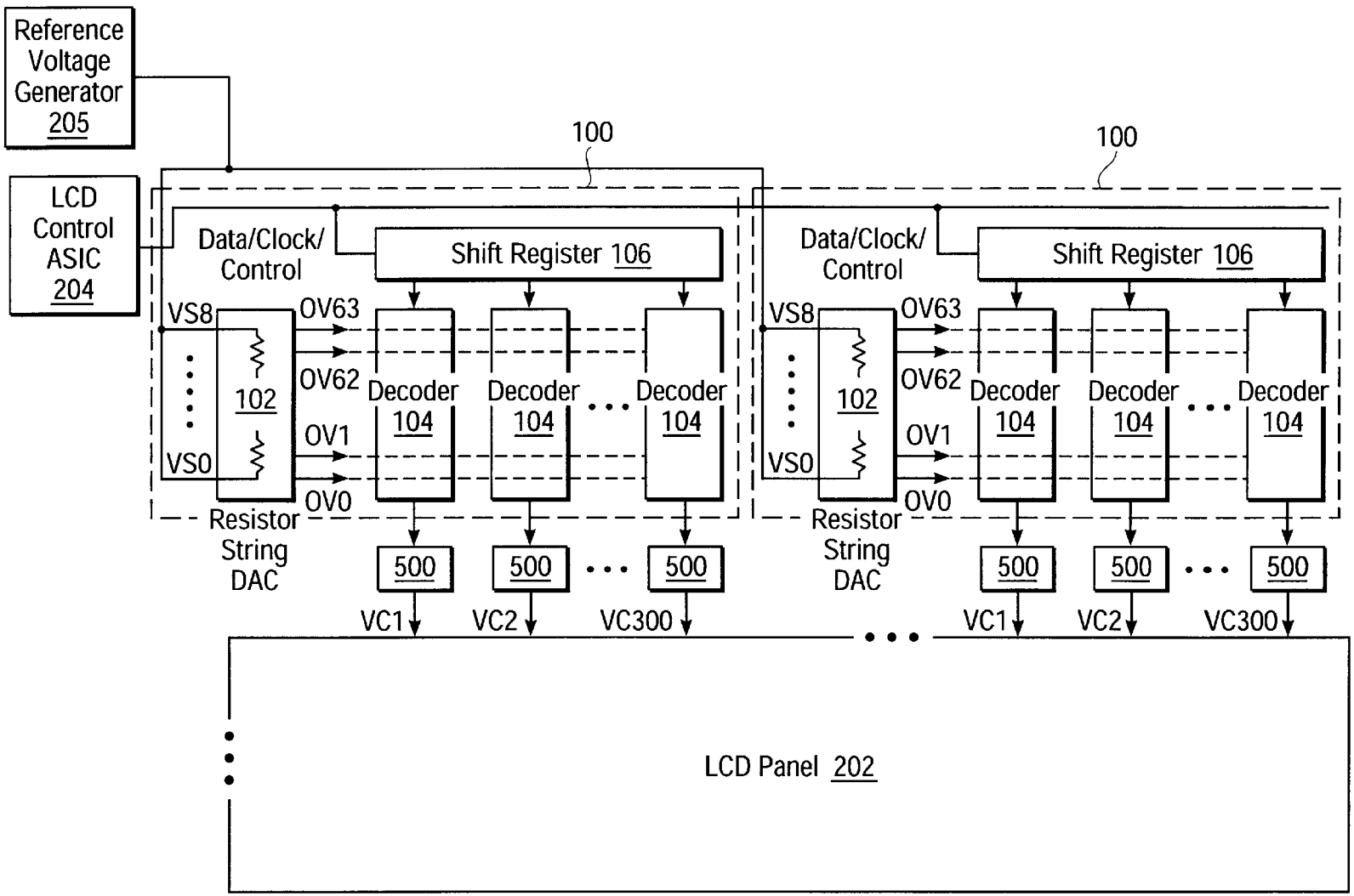
FIG. 5I AUTO-STOP BUFFER SYSTEM 550

SECOND AUTO-STOP BUFFER CIRCUIT 600

FIRST ARCHITECTURE 700

SECOND ARCHITECTURE 800

THIRD ARCHITECTURE 900

SYSTEM AND METHOD FOR DRIVING COLUMNS OF AN ACTIVE MATRIX DISPLAY

I. BACKGROUND OF THE INVENTION

1. Technical Field

This invention relates to electronic circuit designs for column drivers for an active matrix (thin-film transistor) liquid crystal display.

2. Description of Related Art

With recent progress in various aspects of active matrix (thin-film transistor) liquid crystal display technology, the proliferation of active matrix displays has been spectacular in the past several years. In an active matrix display, there is a gate comprised of one transistor or switch corresponding to each display cell. An active matrix display is operated by first applying select voltages to a row electrode to activate the gates of that row of cells, and second applying appropriate analog data voltages to the column electrodes to charge each cell in the selected row to a desired voltage level.

Column drivers are very important circuits in the design of an active matrix display panel. The column drivers receive digital display data and control and timing signals from a display controller chip, convert the digital display data to analog voltages, and drive the analog voltages onto column electrodes of the display.

To convert the digital display data to the analog voltages, existing column drivers use either a resistor-string based digital-to-analog converter (DAC) or a capacitor-based DAC. This invention concerns improving the design of a column driver that uses a resistor-string based DAC. The resistor-string DAC in a conventional column driver includes a single resistor string in combination with multiple decoders (one for each column electrode to be driven). The resistor string DAC interpolates voltages between analog reference levels that are provided to the column driver.

In a column driver using a resistor-string DAC, there are several known techniques for driving the analog voltages onto the column electrodes. The first known technique is a "direct drive" technique in which analog voltages from the output of the resistor string DAC is directly driven to the columns. The second known technique is to use an "ordinary buffer" to buffer the output from a resistor-string DAC to drive the column electrodes. The third known technique is to use a "timed buffer" that is activated in a timely fashion.

In the direct drive technique, the column electrodes are driven directly from the resistor string. This, in theory, may result in accurate voltages because of the inherent linearity of the resistors in the resistor string. However, because the resistance of the resistors must be small in order to drive the column capacitance with sufficient rapidity (since the time constant of the circuit is proportional to the resistance), this direct drive system results in high consumption of power at the resistor string (since power is inversely proportional to the resistance) and hence less current available to drive the columns. In addition, the direct drive technique requires the use of a powerful external reference amplifier circuit in order to increase the drive power on the analog reference levels provided to the resistor string so that the capacitance of the display panel may be driven within a required time. With an external reference amplifier circuit, however, a voltage drop may occur in the printed circuit board (PCB) between the amplifier circuit and the column driver chips because a large DC current must be provided to the resistor-string DAC while AC current must be provided to charge the substantial capacitance of the display panel. Finally, if too many of the decoders select the same tap (between two resistors in the resistor string) such a condition may be aggravated.

In the ordinary buffer technique, the disadvantages of the direct drive system are overcome by interposing analog output buffers in between the column decoders and the column electrodes. In the ordinary buffer technique, because the resistor string does not directly drive the column capacitance, large resistor values may be used to reduce power consumption at the resistor string. In addition, the presence of the analog output buffers eliminates the need for the high current output reference amplifier circuitry, and without the high current output reference amplifier circuitry the problems due to voltage drops in the PCB and in the decoder circuitry can be minimized.

Nevertheless, the ordinary buffer technique has several disadvantages. Since each column driver typically supports three hundred columns and each column requires a buffer, a large number of buffers are needed. In addition, these buffers consume a large amount of power and are not power efficient. Finally, the voltage offset of these buffers causes voltage inaccuracy.

In the timed buffer technique, each analog output buffer in the ordinary buffer system is replaced with a timed buffer circuit that includes a buffer, a switch, and timing and control circuitry. In a first "predrive" stage, the switch is turned off, and the buffer drives the column capacitance without drawing substantial current from the resistor string. In a second "precision drive" stage, the buffer is turned off, and the switch is turned on so that the column capacitance is driven to its final value directly from the resistor string.

The timed buffer technique reduces the large power consumption at the buffers because after the first stage the buffers are turned off. In addition, since the final value is driven by the resistor string, there is no voltage offset.

However, the timed buffer technique has disadvantages. It requires additional control and timing circuitry to control and time its two-stage operation. Furthermore, it still requires a large number of buffers since one is needed for each column.

II. SUMMARY

The present invention relates to a system and method for driving columns of an active matrix display that addresses the above described problems. The present invention includes an auto-stop buffer circuit that drives an analog data voltage in two steps—the first step being active buffering by a "dead-zone amplifier" before the output reaches a certain level and the second step being acting as a passive conduit after the output reaches the certain level. The dead-zone amplifier inherently turns itself off when the analog voltage reaches the certain level.

The present invention also includes various column driver architectures in which buffers are placed in various ways in a column driver in between the resistor-string DAC and the column decoders in order to minimize the number of required buffers. Placing the buffers in between the resistor-string DAC and the column decoders decreases the number of buffers required to one buffer per analog data (gray-scale) voltage level, instead of one buffer per column.

III. BRIEF DESCRIPTION OF THE DRAWINGS

Figure 4:
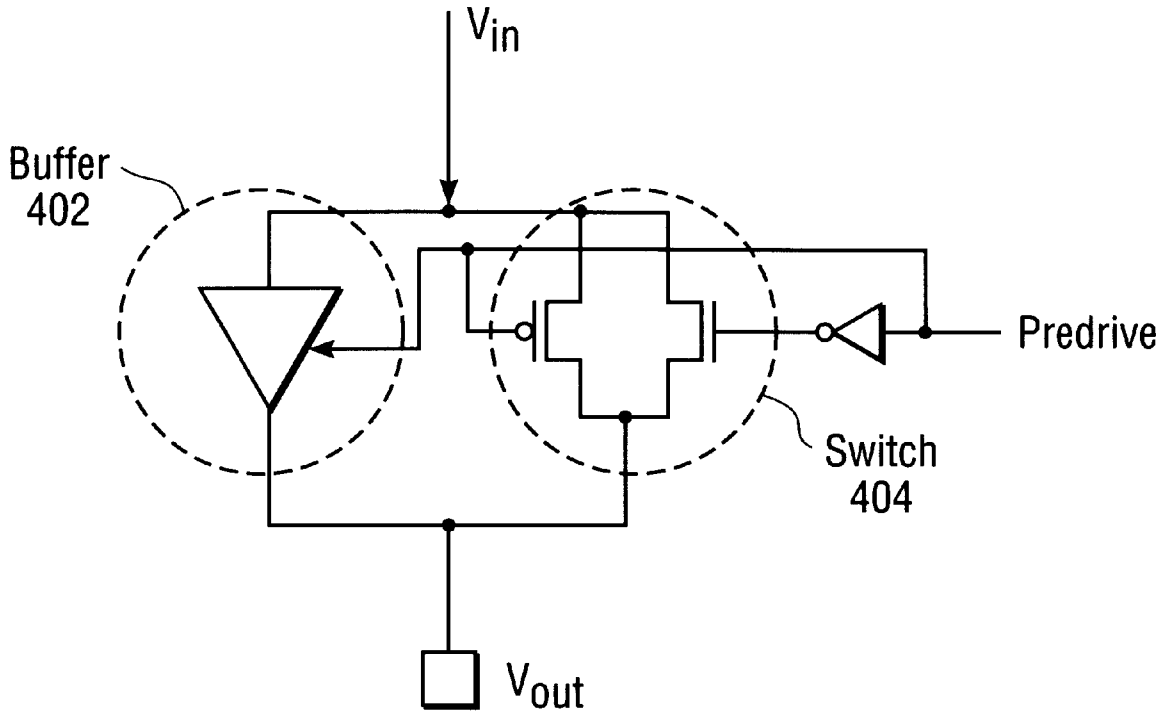
FIG. 4 (Prior Art)
FIG. 4 is a diagram of a timed buffer circuit, including a timed buffer and a timed switch.
Figure 4A:
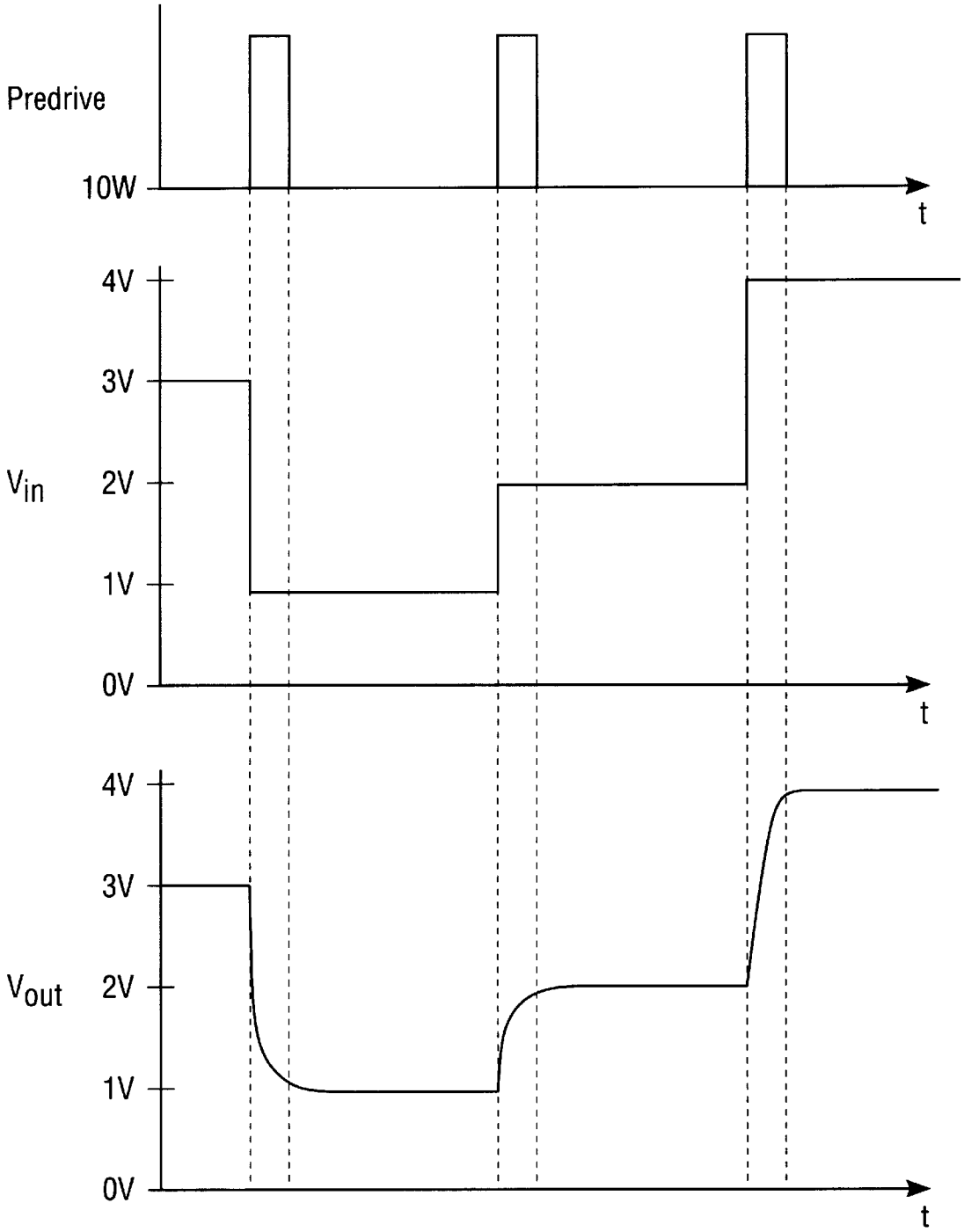
FIG. 4A (Prior Art)

FIG. 4A presents timing diagrams of signals for a timed buffer circuit.

Figure 4B:
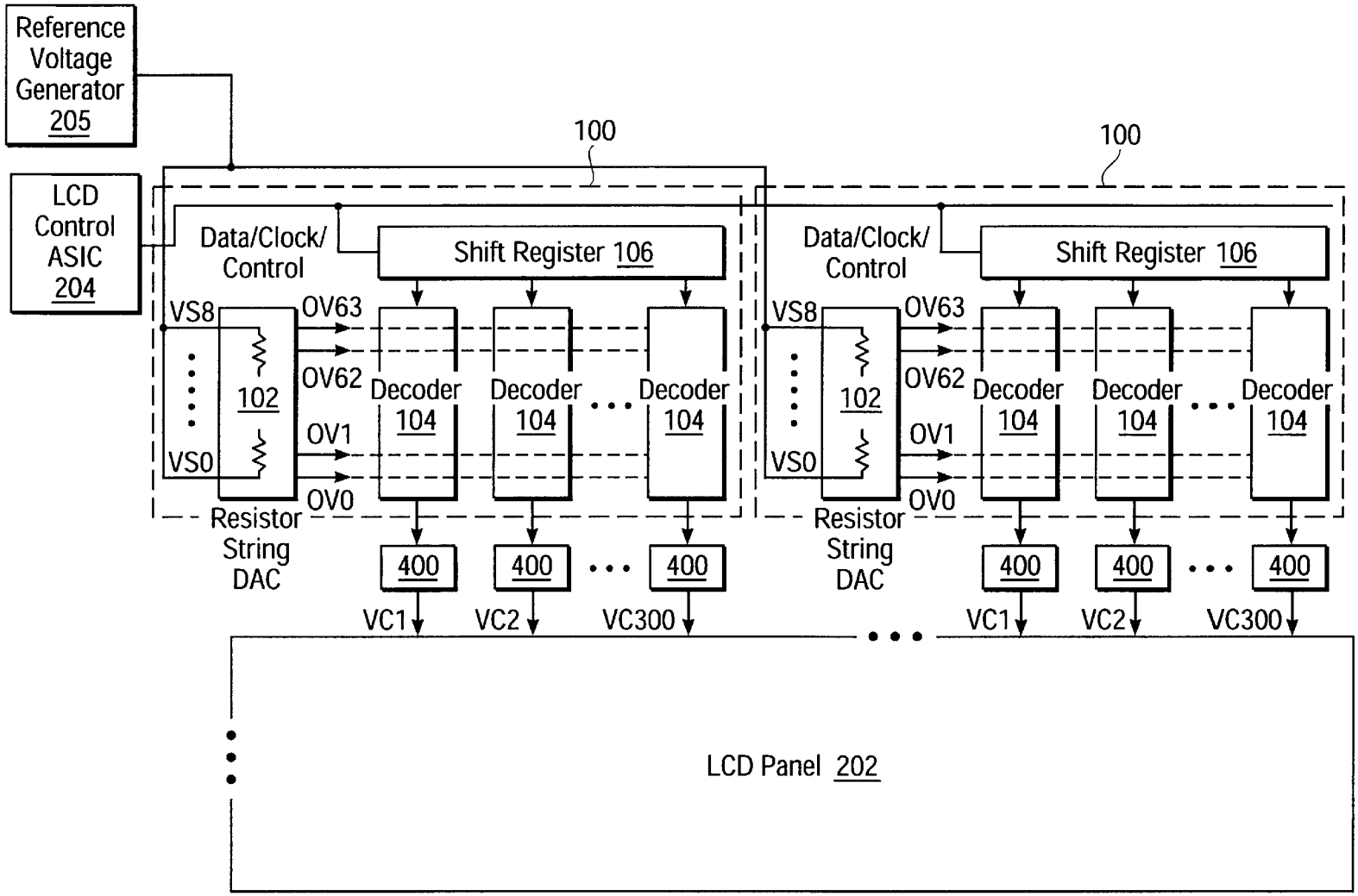
FIG. 4B (Prior Art)

FIG. 4B is a diagram of a timed buffer system, including multiple timed buffer circuits.

Figure 5:
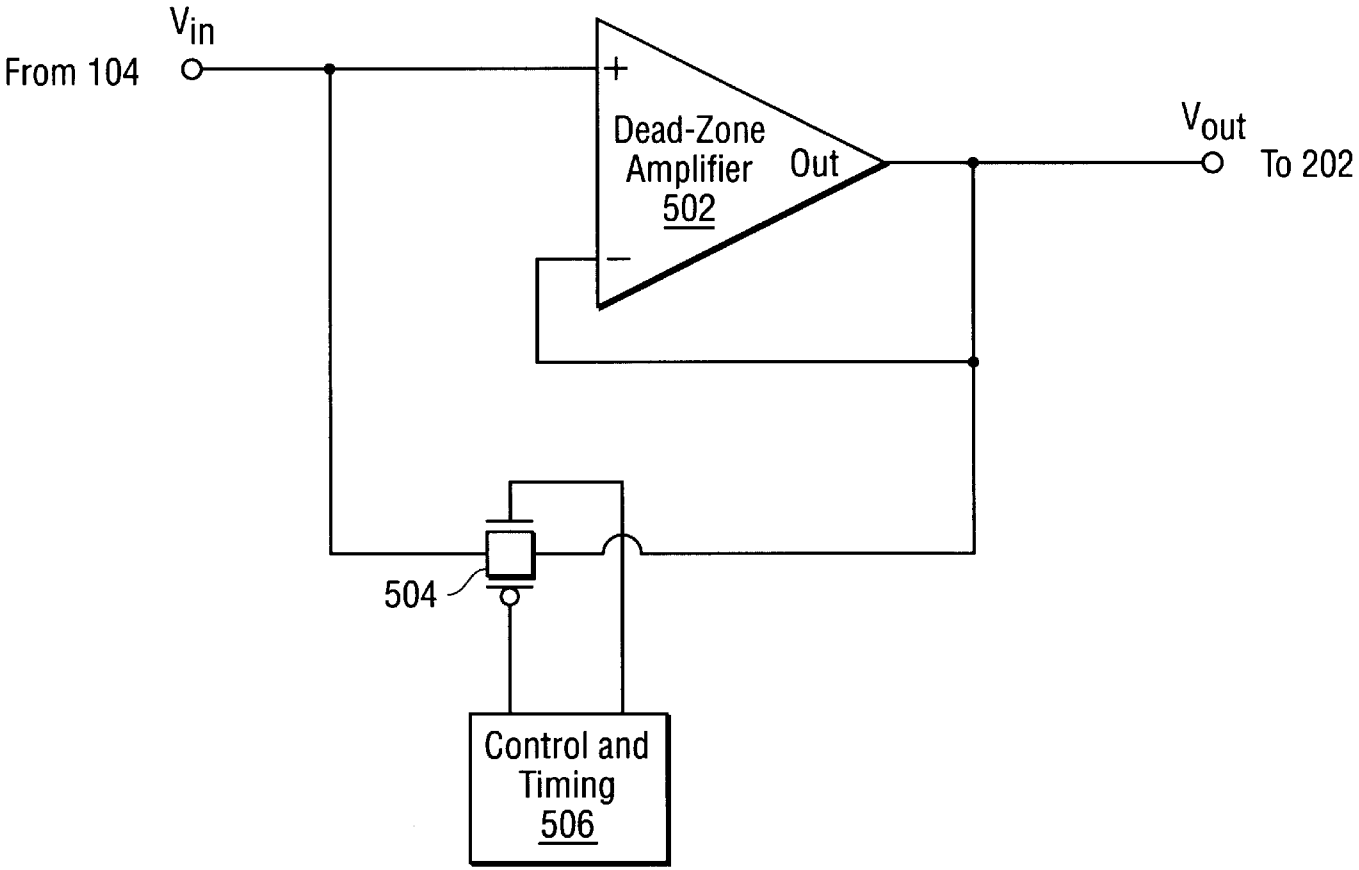

FIG. 5 is a diagram of a first and preferred auto-stop buffer circuit, including a dead-zone buffer and a precision drive switch, in a preferred embodiment of the present invention.

Figure 5A:
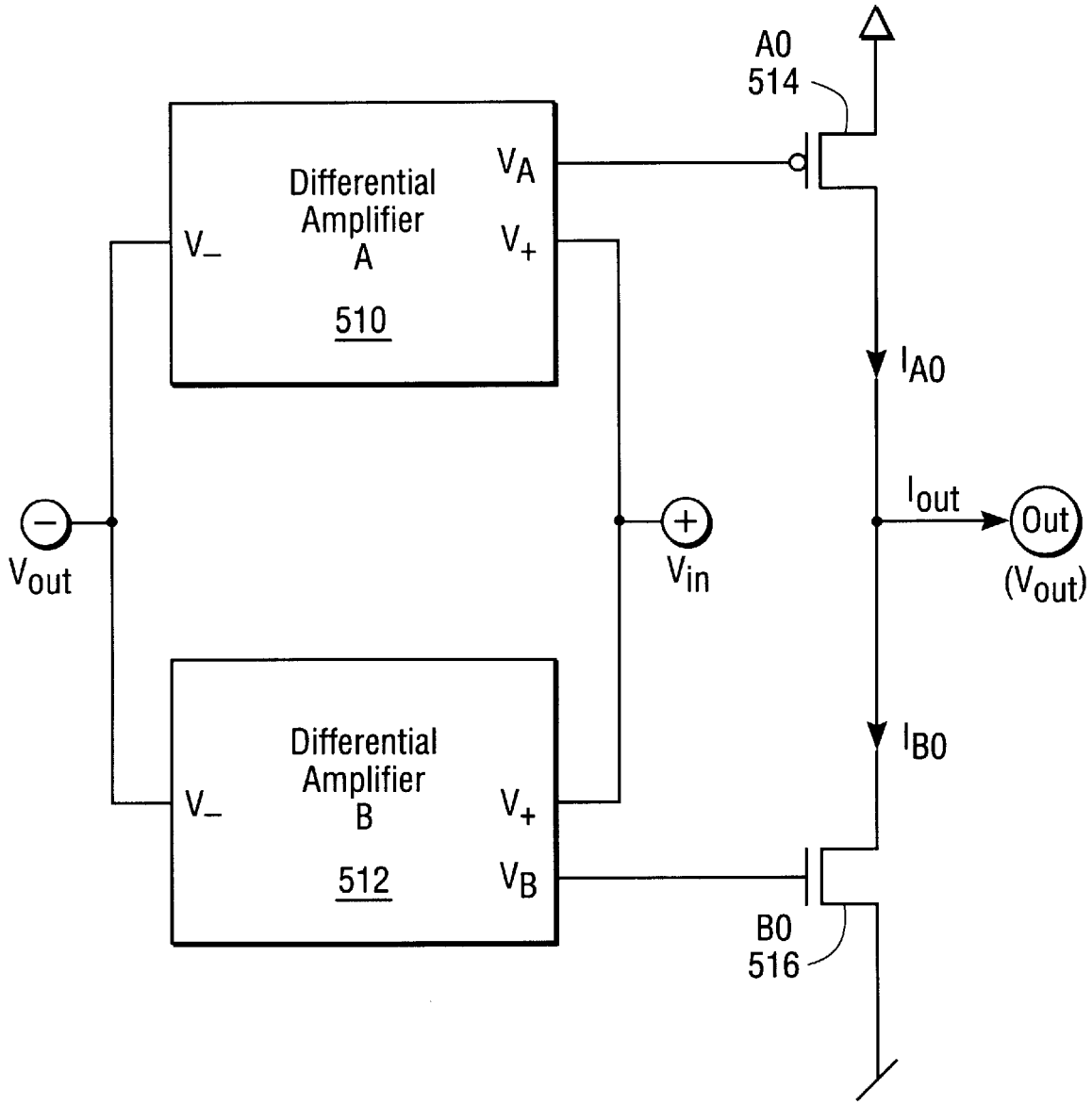

FIG. 5A is a diagram showing an implementation of the dead-zone amplifier, including differential amplifier A and differential amplifier B, in a preferred embodiment of the present invention.

Figure 5B:
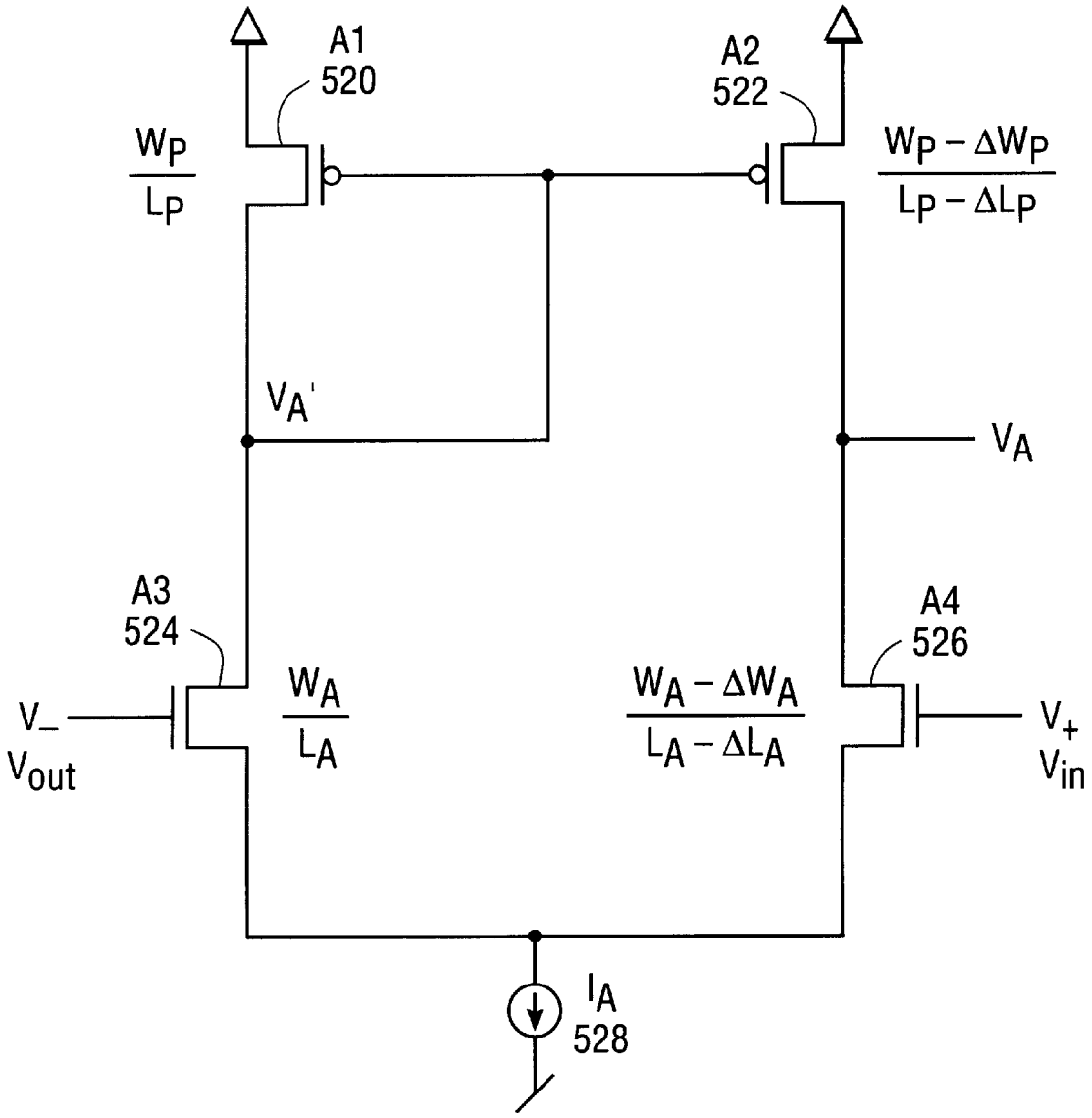

FIG. 5B is a diagram of the differential amplifier A in a preferred embodiment of the present invention.

Figure 5C:
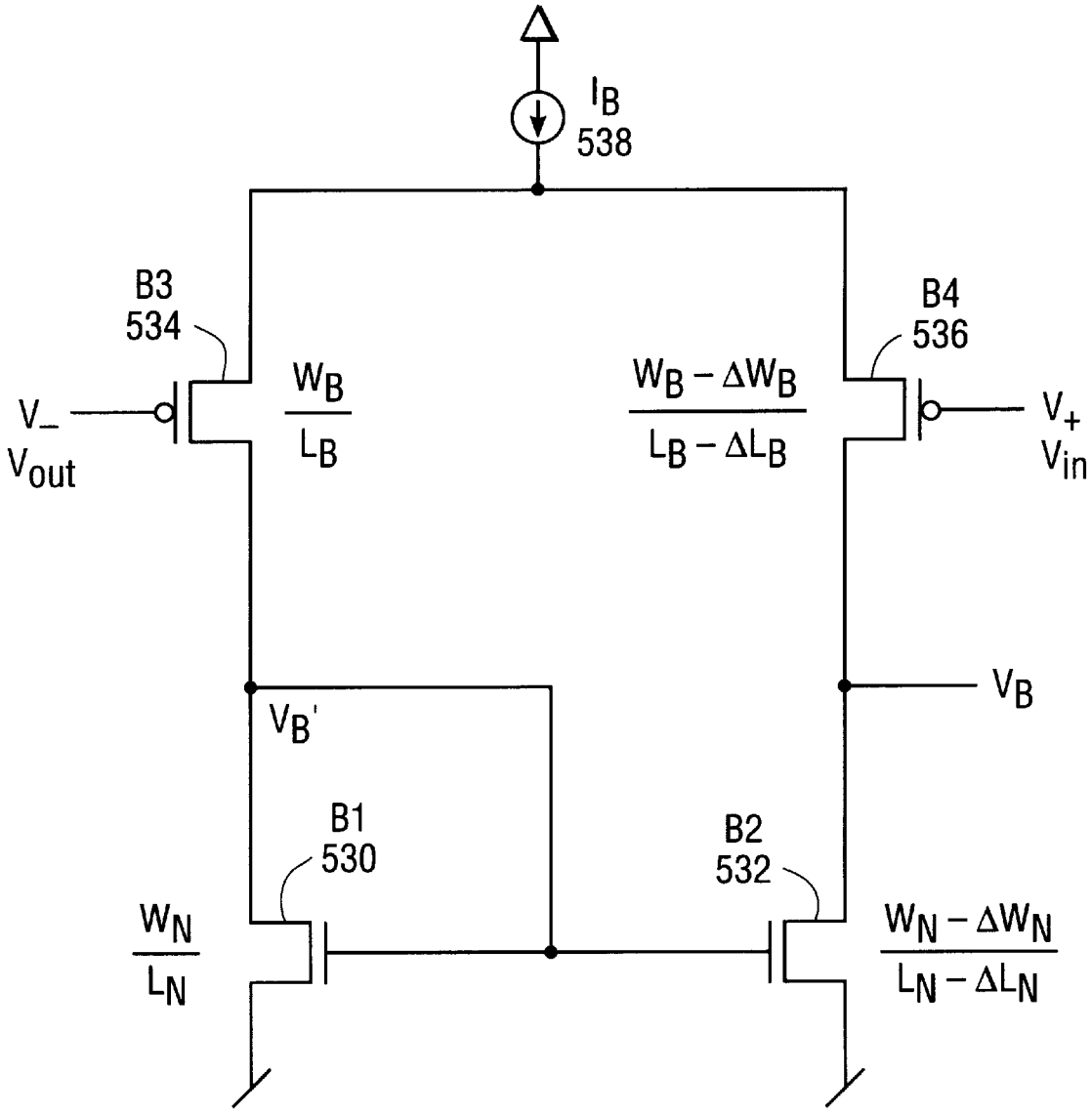

FIG. 5C is a diagram of the differential amplifier B in a preferred embodiment of the present invention.

Figure 5D:
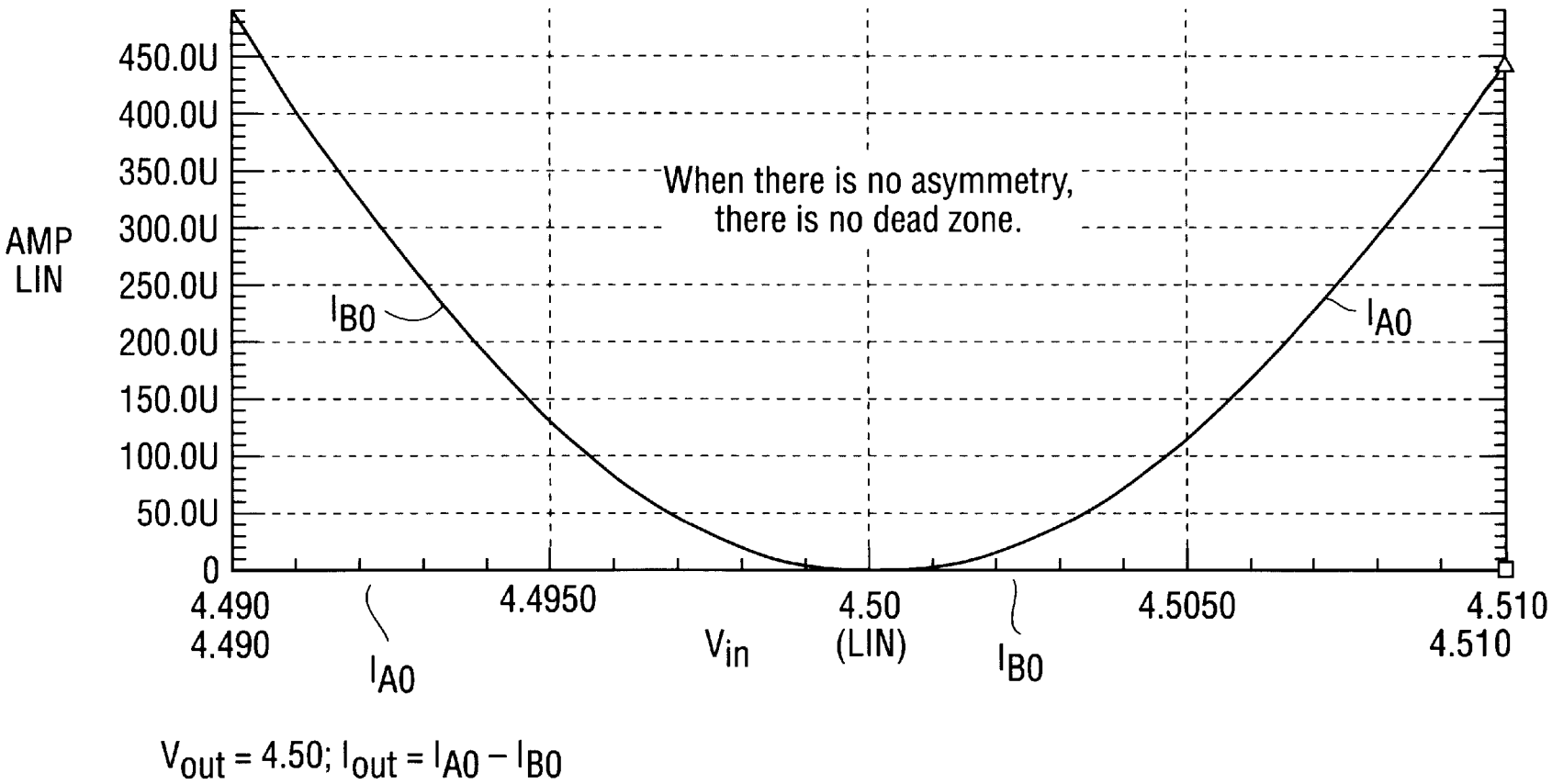

FIG. 5D is a graph which shows the simulation result of a transfer characteristic for an amplifier with conventional symmetric differential amplifiers.

Figure 5E:
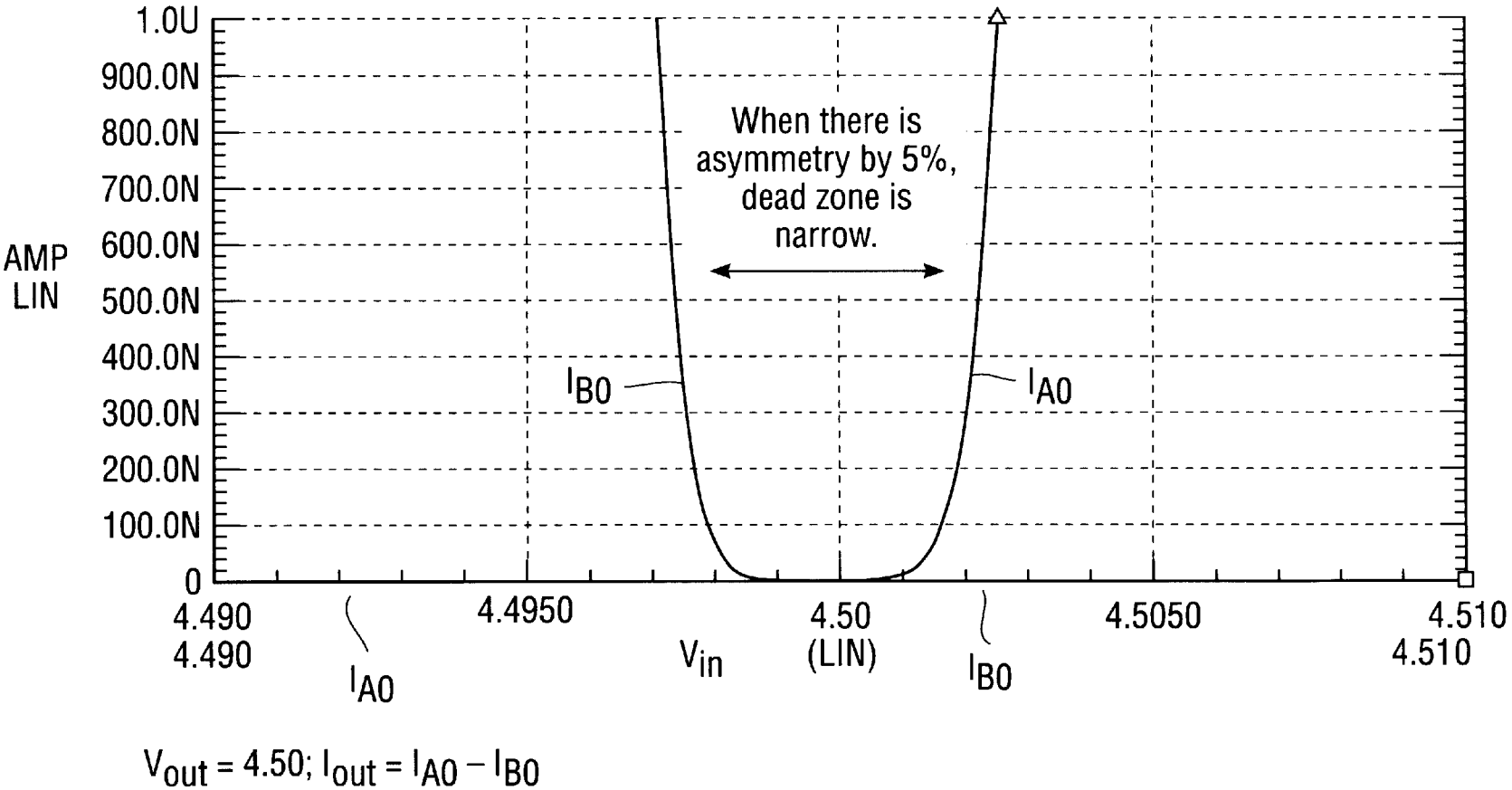

FIG. 5E is a graph which shows the simulation result of a transfer characteristic for a dead-zone amplifier with 5% asymmetry on differential amplifiers.

Figure 5F:
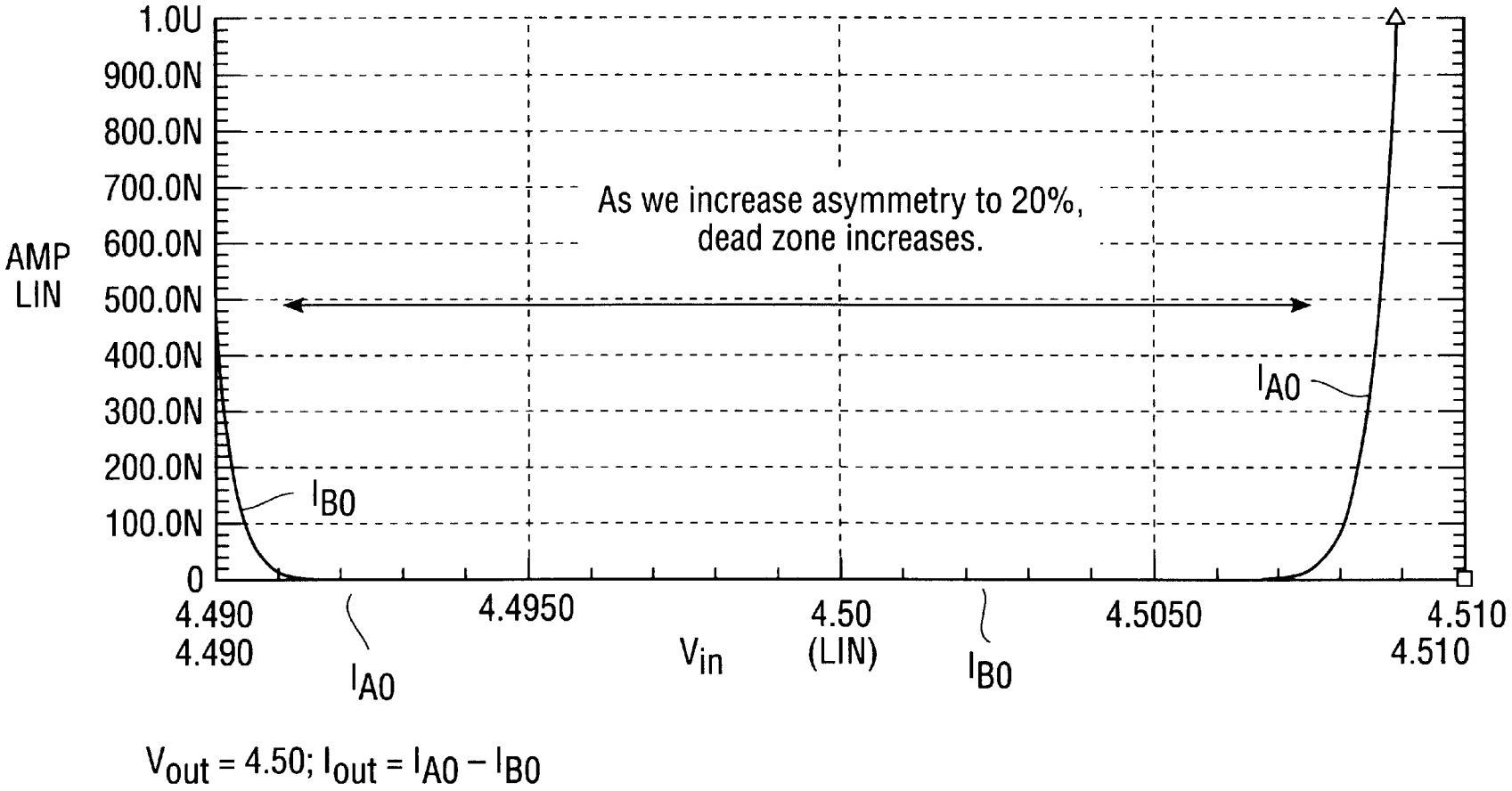

FIG. 5F is a graph which shows the simulation result cf a transfer characteristic for a dead-zone amplifier with 20% asymmetry on differential amplifiers.

Figure 5G:
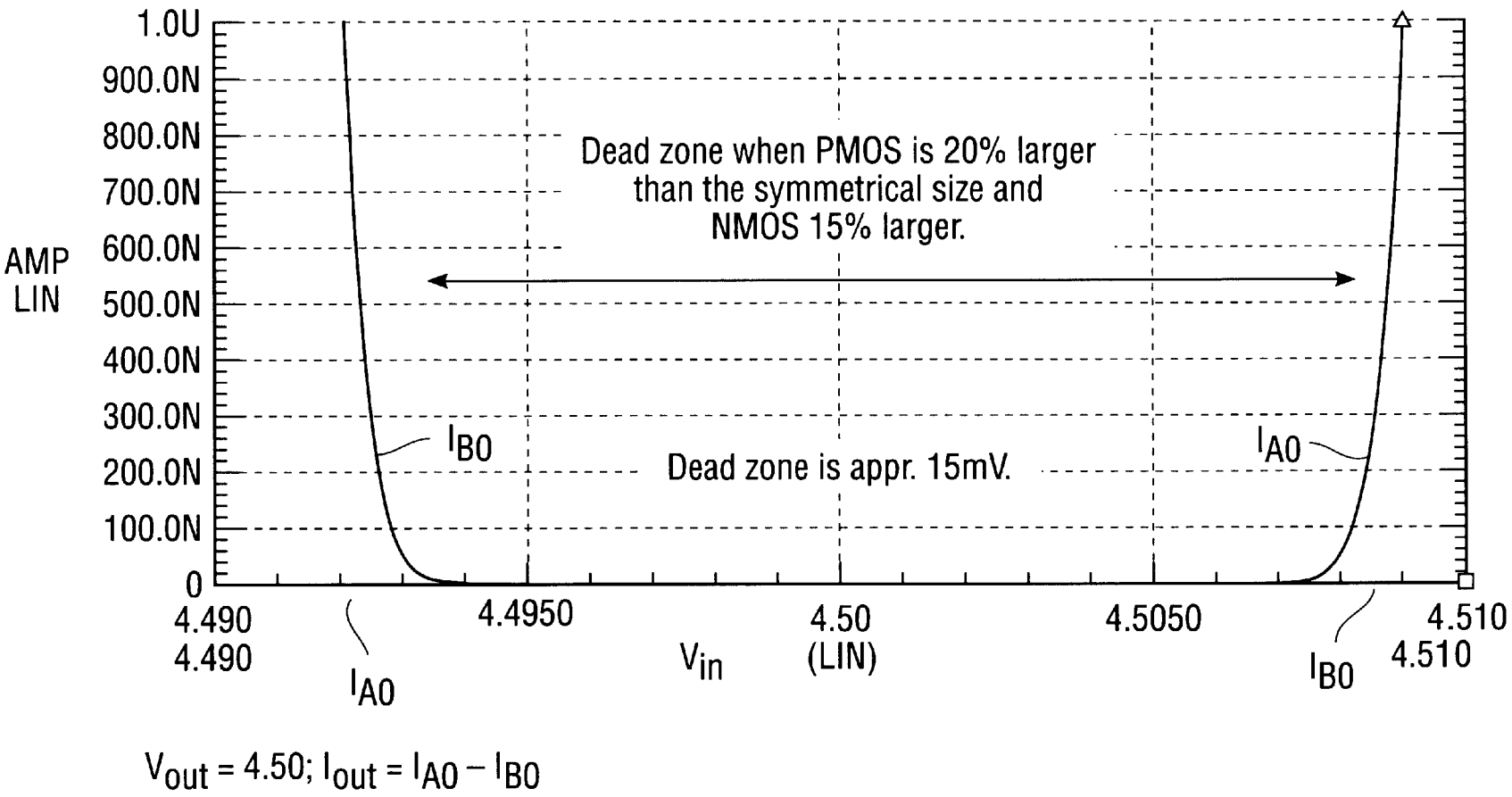

FIG. 5G is a graph which shows the simulation result of a transfer characteristic for a dead-zone amplifier with 20% asymmetry in differential amplifier A and 15% asymmetry in differential amplifier B.

Figure 5H:
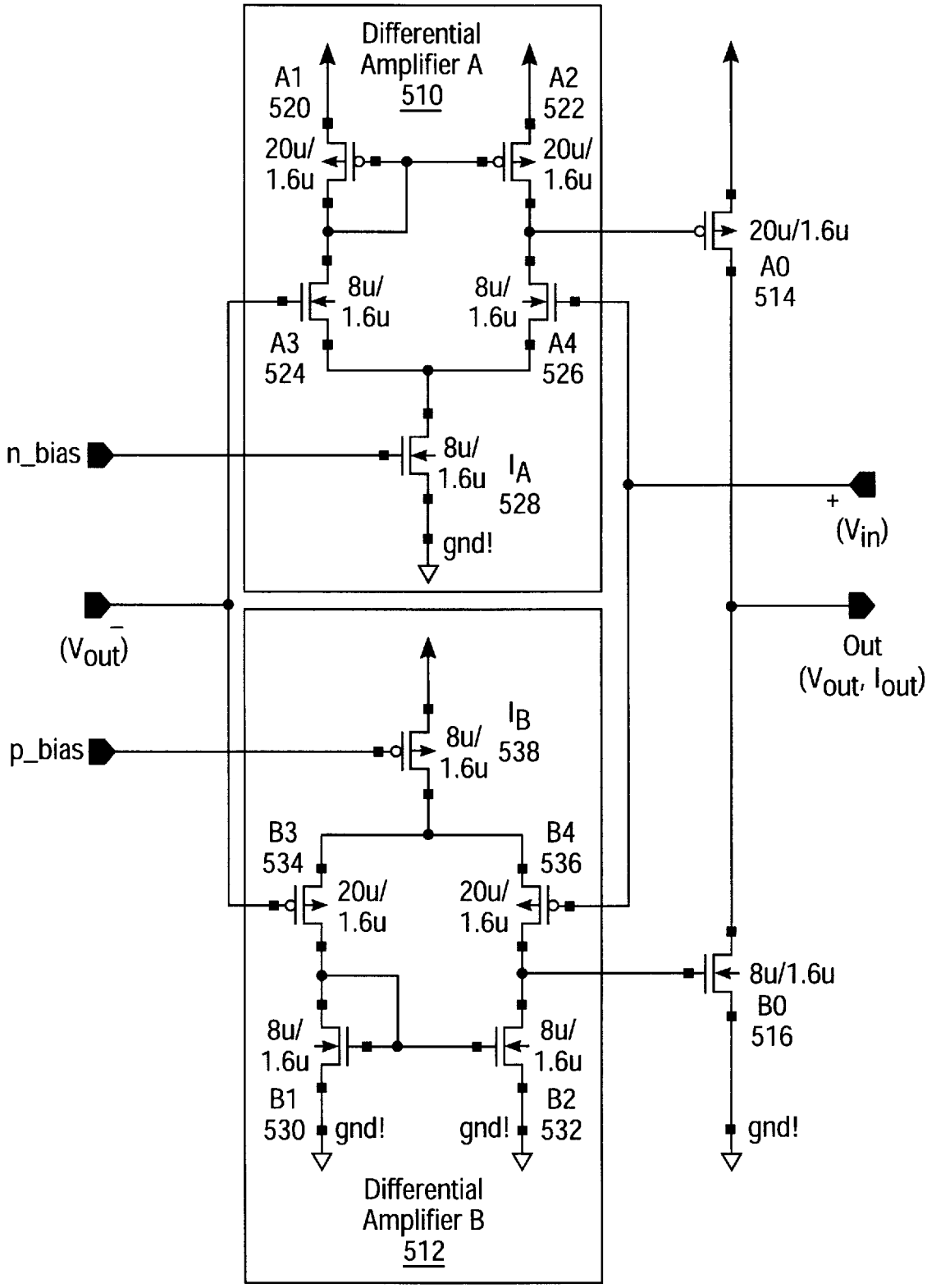

FIG. 5H is a transistor level diagram of a dead-zone amplifier with the dead-zone characteristic shown in FIG. 5G, in a preferred embodiment of the present invention.

FIG. 5I is a diagram of an auto-stop buffer system, including multiple auto-stop buffer circuits, in a preferred embodiment of the present invention.

Figure 6:
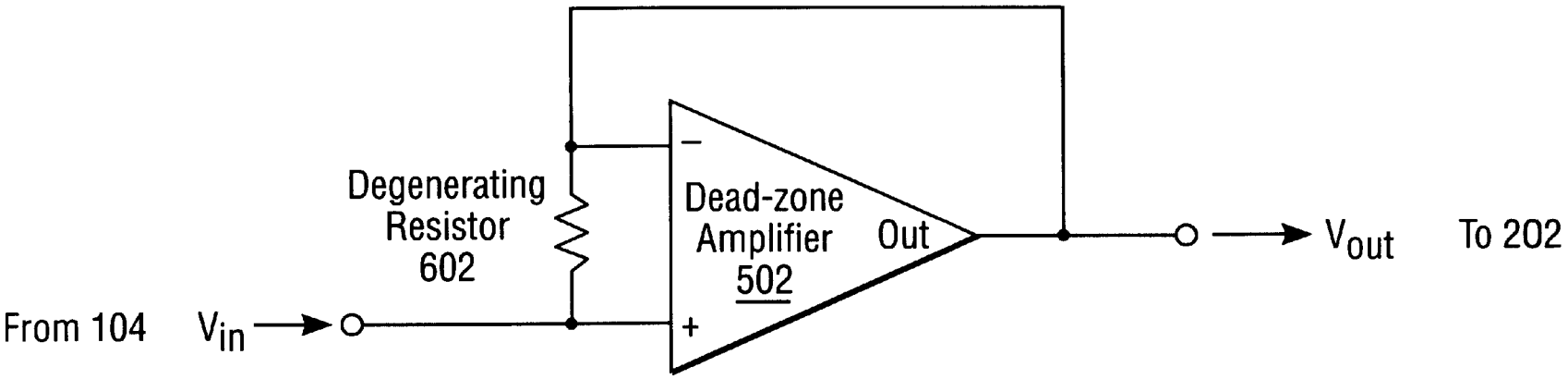

FIG. 6 is a diagram of a second and alternate auto-stop buffer circuit, including a dead-zone buffer and a degenerating resistor, in an alternate embodiment of the present invention.

Figure 7:
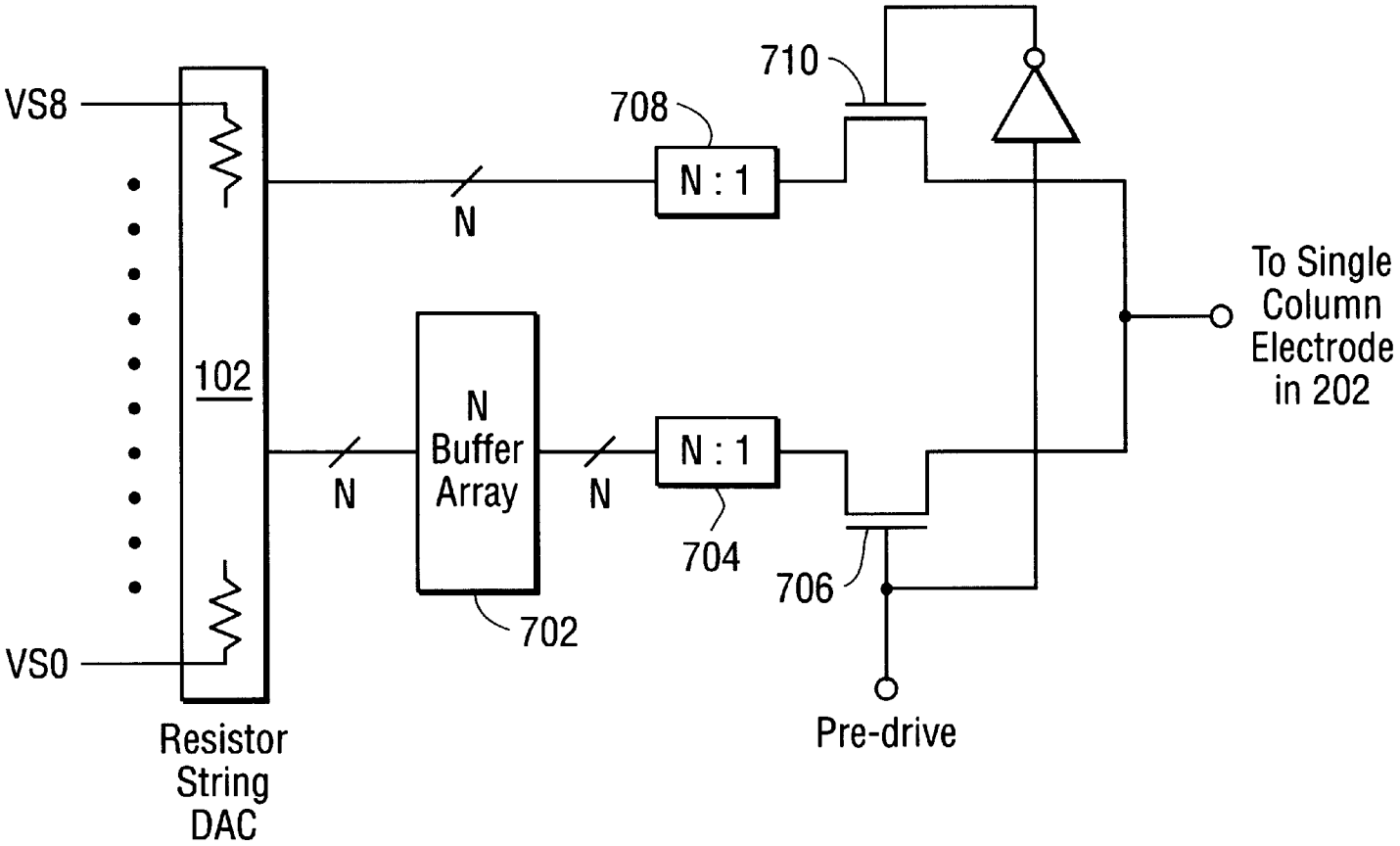

FIG. 7 is a diagram of a first column driver architecture in an alternate embodiment of the present invention.

Figure 8:
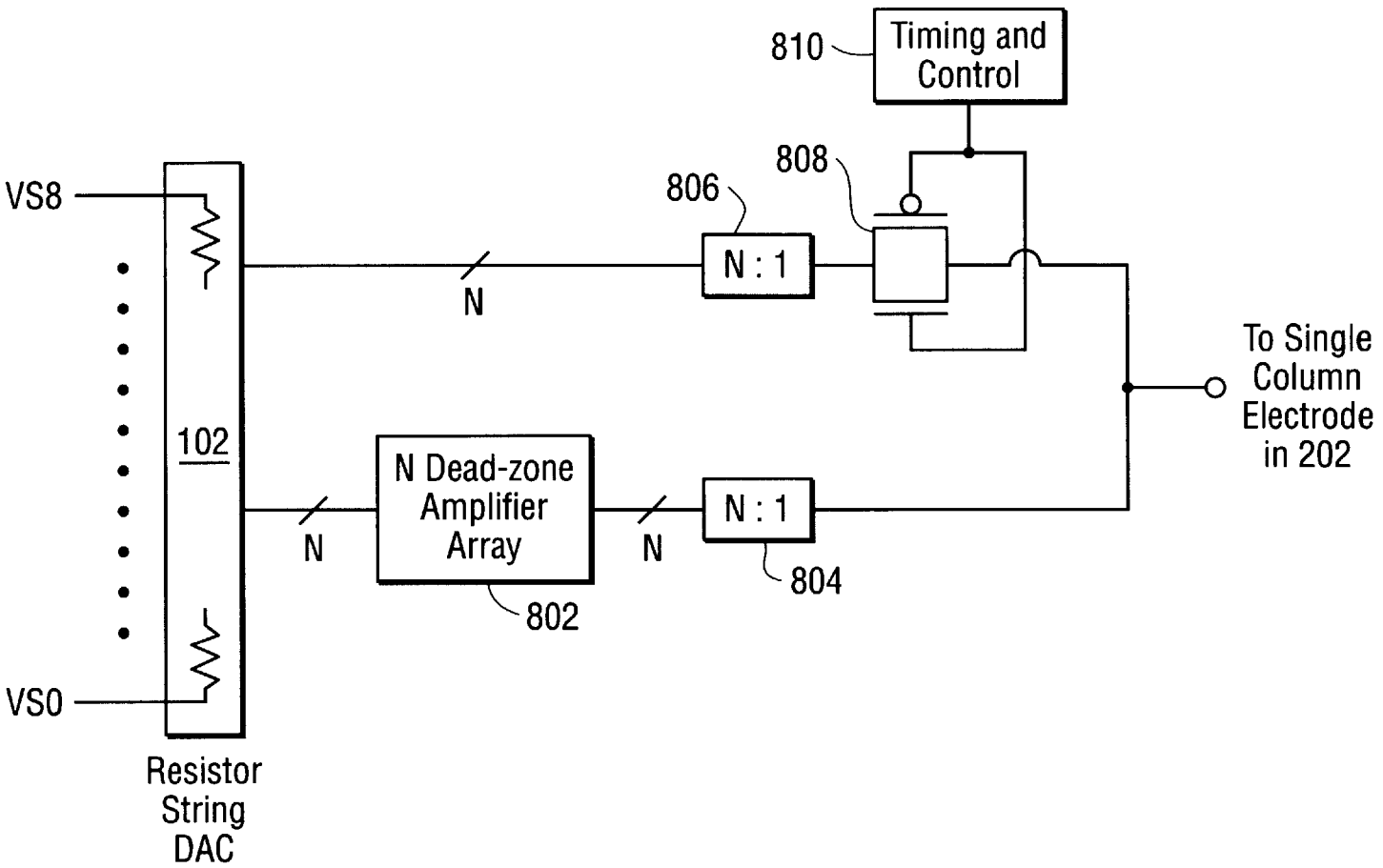

FIG. 8 is a diagram of a second column driver architecture in an alternate embodiment of the present invention.

Figure 9:
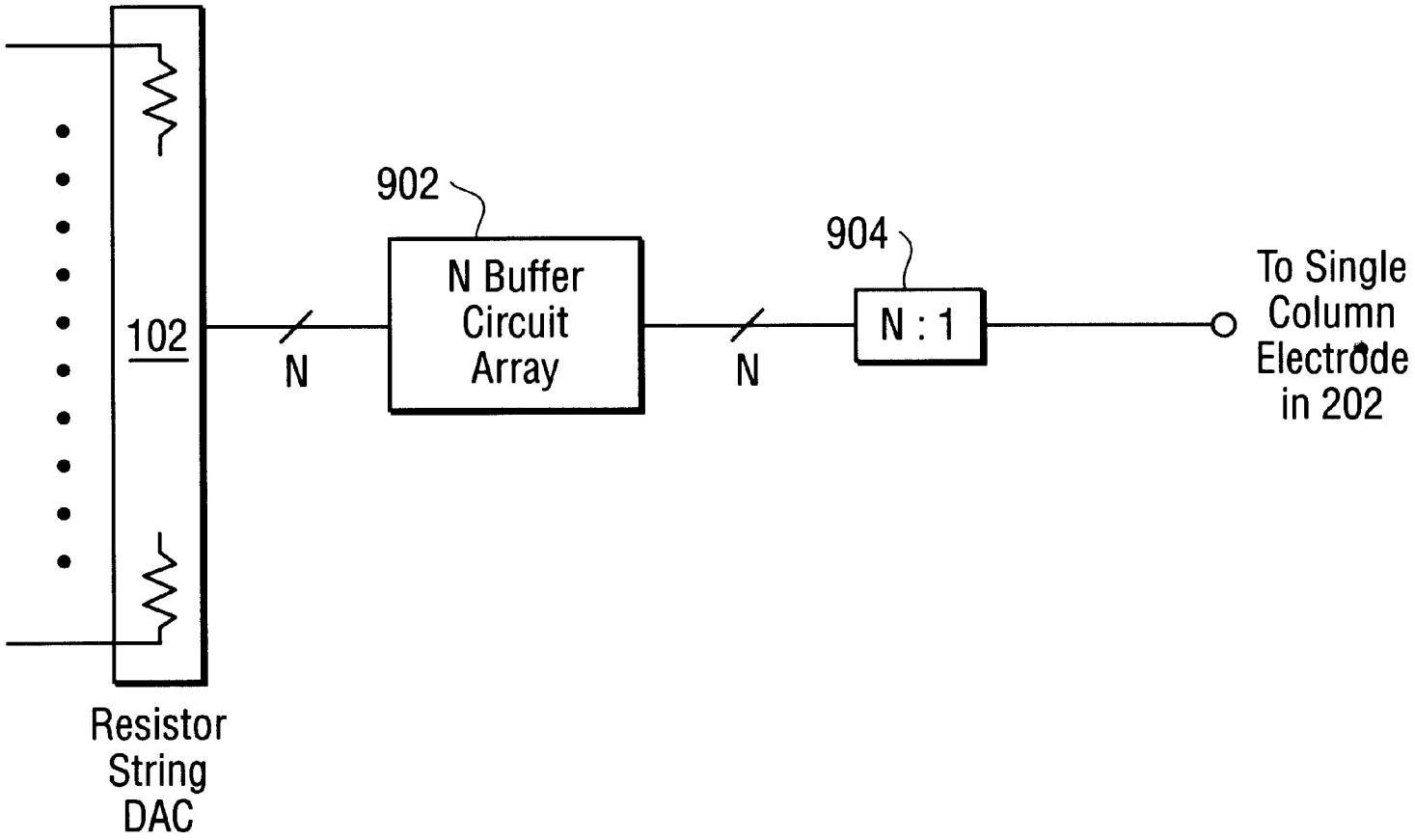

FIG. 9 is a diagram of a third column driver architecture in an alternate embodiment of the present invention.

IV. DESCRIPTION OF THE PREFERRED EMBODIMENTS

The preferred embodiments of the present invention are now described with reference to the figures.

Figure 1:
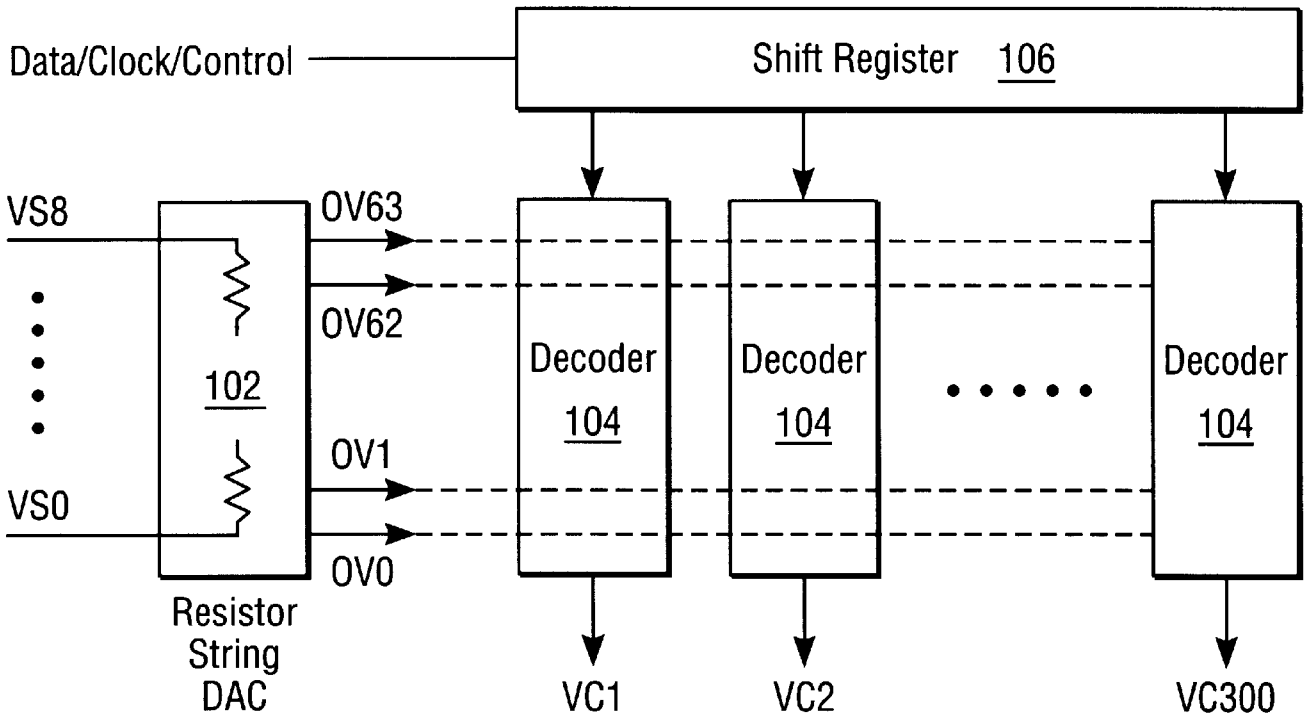
FIG. 1 (Prior Art)
FIG. 1 is a diagram of the basic structure of a column driver which includes a resistor-string based DAC.

FIG. 1 is a diagram of the basic structure of a column driver 100 which includes a resistor-string based DAC 102. The basic functionality of the column driver 100 is to drive columns of an LCD panel according to the value of digital data, clock, and control inputs. The range of analog voltages required to drive the panel is generated by a resistor string 102. The resistor string typically receives two sets of analog reference voltages to make inversion easy to implement. One set of analog reference voltages (VS0, VS1, VS2, . . . , VS7, VS8) is illustrated in FIG. 1. The resistor string 102 interpolates voltages between the analog reference voltages and generates N output voltages (e.g., OV0, OV1, OV2, . . . , OV62, OV63), where N is typically a power of 2 (e.g., 64). These N output voltages are transmitted to a large number (e.g., 300) of N:1 decoders 104. Each decoder 104 is an N-to-1 multiplexer that uses data and clock signals received from a shift register 106 to select a single one of the N output voltages. As shown in FIG. 1, the voltage selected by the first decoder 104 is denoted VC1, the voltage selected by the second decoder 104 is denoted VC2, and so on. These selected voltages (e.g., VC1, VC2, VC3, . . . , VC299, VC300) are outputted by the column driver 100.

Figure 2:
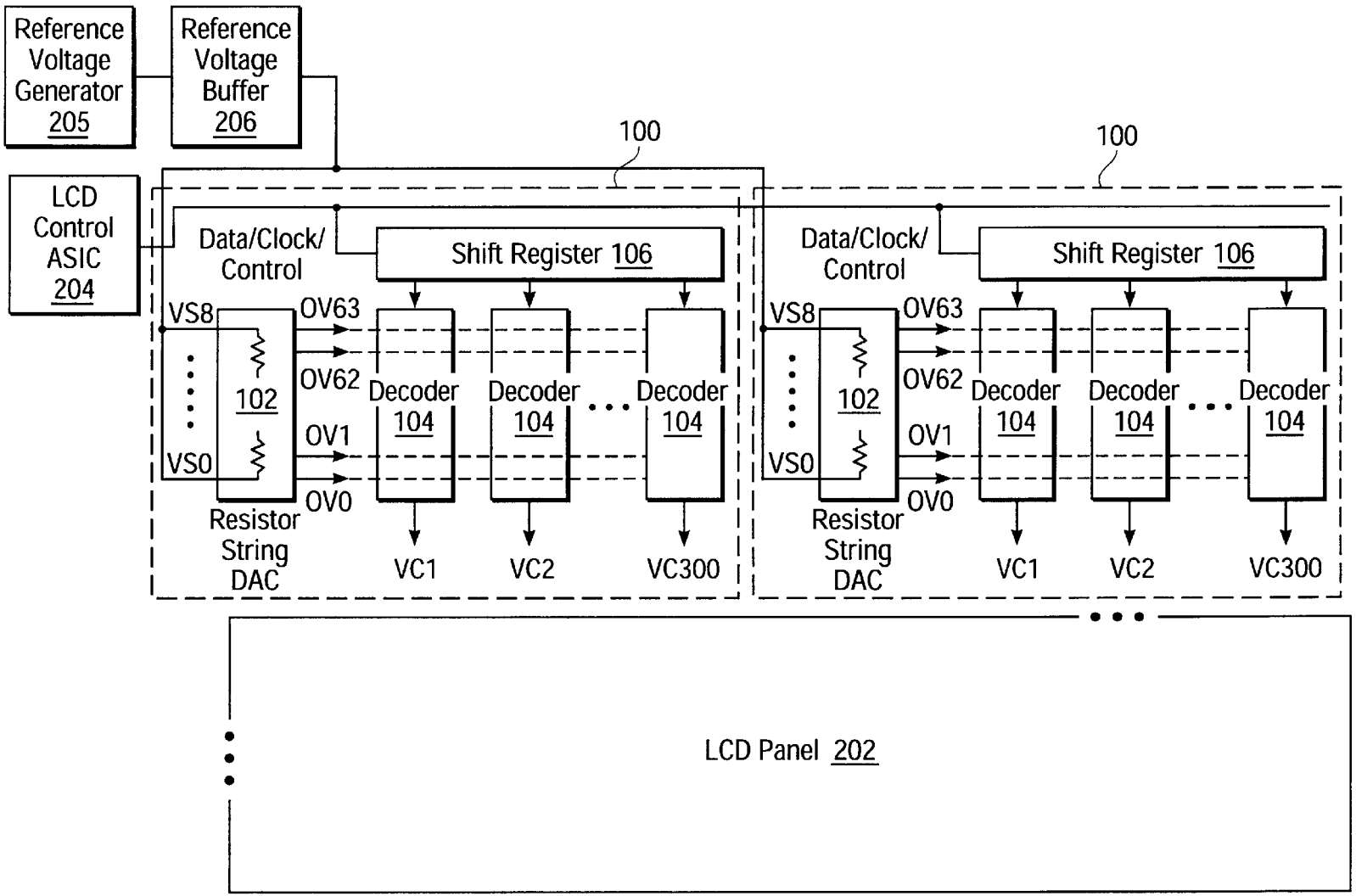
FIG. 2 is a diagram of a direct drive system, including multiple column drivers.

FIG. 2 is a diagram of a direct drive system 200, including multiple column drivers 100. The resistor strings 102 of the column drivers 100 directly drive (through the decoders 104) the columns of an LCD panel 202. Data, clock, and control signals are received by the shift registers 106 of the column drivers 100 from an LCD control ASIC (application specific integrated circuit) 204. Analog reference levels (VS0, VS1, VS2, . . . , VS7, VS8) are generated by a reference voltage generator 205. Reference voltage buffers 206 is required in order to boost the power of the analog reference levels to a sufficiently high power level so that substantial capacitance of The LCD panel 202 may be driven directly from the resistor strings 102.

Figure 3:
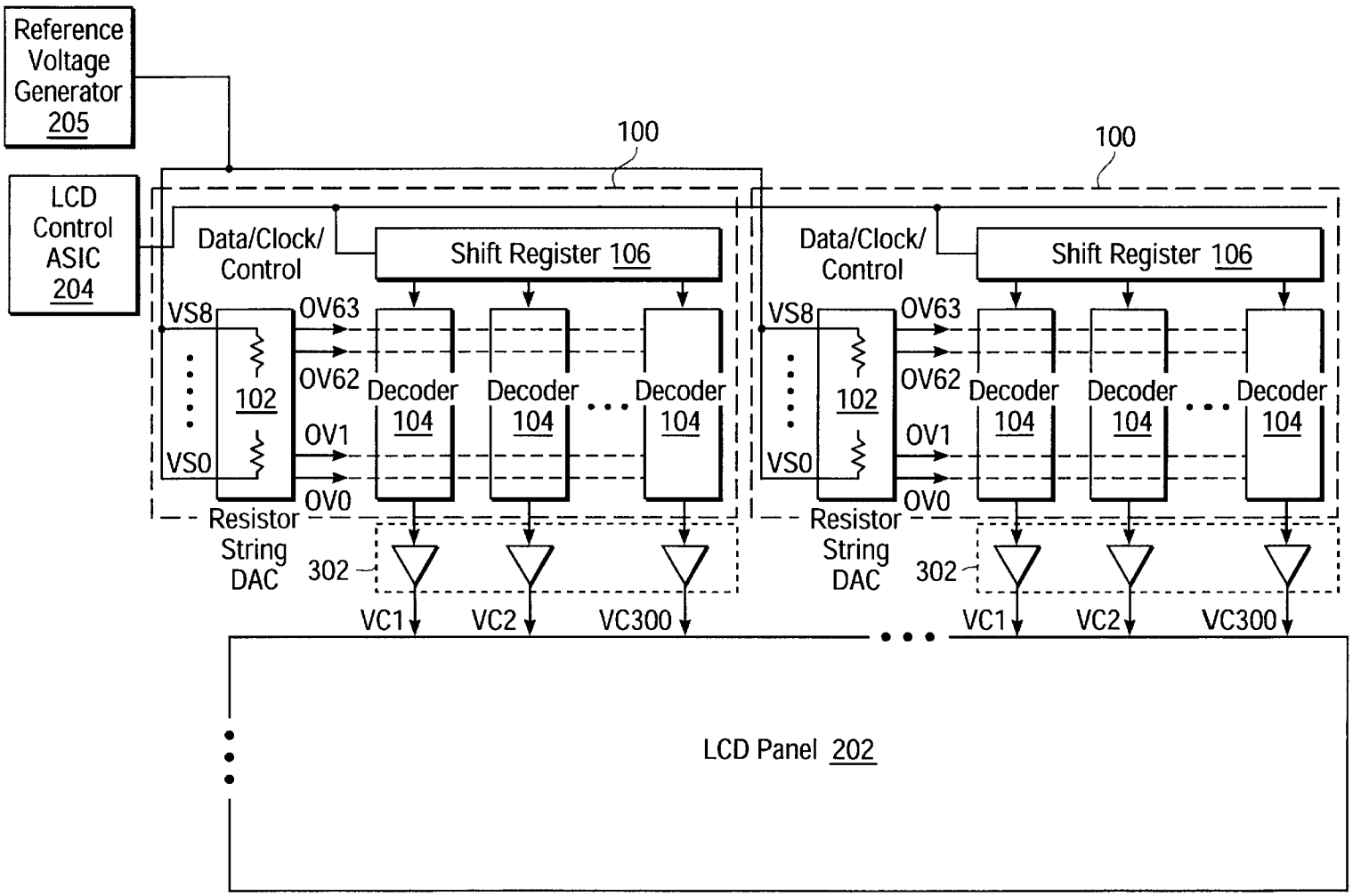
FIG. 3 (Prior Art)
FIG. 3 is a diagram of an ordinary buffer system, including multiple column drivers.

FIG. 3 is a diagram of an ordinary buffer system 300, including multiple column drivers 100. Ordinary buffers 302 receive low-power voltages (VC1, VC2, VC3, . . . , VC299, VC300) selected by the decoders 104 and boost the power of these voltages before outputting them to the LCD panel 202. Because of the ordinary buffers 302, the reference voltage buffers 206 in the direct drive system 200 are not necessary.

FIG. 4 is a diagram of a timed buffer circuit 400, including a timed buffer 402 and a timed switch 404. In addition, the timed buffer circuit 400 requires additional timing and control circuitry to supply a predrive signal to the timed buffer 402 and the timed switch 404. The timed buffer circuit 400 is designed to be placed between a column decoder 104 (connected to $V_{in}$) and a column electrode (connected to $V_{out}$).

FIG. 4A presents timing diagrams of signals showing the two-stage operation of the timed buffer circuit 400. The two stages are a predrive stage and a precision drive stage.

The predrive stage occurs when the predrive signal is high. The predrive stage may, for example, be two microseconds in length. During the predrive stage, the timed switch 404 is turned off while the timed buffer 402 pumps its current from a power supply line to the capacitative load of the column without drawing substantial current from the resistor array 102. Towards the end of the predrive stage, the output voltage ($V_{out}$) of the timed buffer circuit 400 will be very close to the input voltage ($V_{in}$) within an error of a few millivolts. The error is due in part to the offset voltage of the timed buffer 402.

The precision drive stage occurs when the predrive signal is low. During the precision drive stage, the timed buffer 402 is turned off while the timed switch 404 gets turned on to drive the output voltage ($V_{out}$) to its final value which is equal to the input voltage ($V_{in}$). In this way, the precision drive stage overcomes the error due in part to the offset voltage of the timed buffer 402. Since the resistor string 102 drives the analog data voltage during the precision drive stage, there is no offset in steady state. Moreover, because the predrive stage brings the output voltage ($V_{out}$) very close to its final value, the settling time during the precision drive stage is greatly reduced, thereby reducing the amount of power needed to be supplied by the resistor string and so enabling the use of large resistance values in the resistor string.

FIG. 4B is a diagram of a timed buffer system 450, including multiple timed buffer circuits 400. The timed buffer system 450 is similar to the ordinary buffer system 300, except the ordinary buffers 302 are replaced by the timed buffer circuits 400. Moreover, additional timing and control circuitry is required to operate the timed buffer circuits 400.

FIG. 5 is a diagram of a first and preferred auto-stop buffer circuit 500, including a dead-zone amplifier 502 and a precision drive switch 504, in a preferred embodiment of the present invention. The input of the circuit ($V_{in}$) goes into the noninverting input terminal (+) of the dead-zone amplifier 502. The output of the first auto-stop buffer circuit 500 comes from the output terminal (out) of the dead-zone amplifier 502. The output of the circuit ($V_{out}$) is also connected to the inverting input terminal (−) of the dead-zone amplifier 502.

The configuration described so far is similar to a voltage follower configuration of an operational amplifier (when the switch 504 is open). However, as described below, there are differences between the dead-zone amplifier 502 and a conventional operational amplifier. In particular, the dead-zone amplifier 502 is designed so that it shuts off automatically if its output voltage ($V_{out}$) is relatively close to its input voltage ($V_{in}$).

In addition, the first auto-stop buffer circuit 500 includes the precision drive switch 504 which is interposed between the input ($V_{in}$) and the output ($V_{out}$) of the circuit 500. The precision drive switch 504 is controlled by control and timing circuitry 506 in such a way that the precision drive switch 504 is turned on when the dead-zone amplifier 504 shuts down.

Thus, the dead-zone amplifier 502 drives the output voltage ($V_{out}$) until it is relatively close to the input voltage ($V_{in}$), then the precision drive switch 504 drives the output voltage ($V_{out}$) the rest of the way until it is equal to the input voltage ($V_{in}$).

FIG. 5A is a diagram showing an implementation of the dead-zone amplifier 502 in a preferred embodiment of the present invention. The dead-zone amplifier 502 has two input terminals, a noninverting terminal (+) and an inverting terminal (−), and an output terminal (out). The noninverting terminal (+) is connected to the noninverting input terminal (V+) of two differential amplifiers A 510 and B 512, while the inverting terminal (−) is connected to the inverting input terminal (V−) of two differential amplifiers A 510 and B 512. In addition, differential amplifier A 510 has an output terminal ($V_A$) which connects to the gate of an output transistor A0 514, and differential amplifier B 512 has an output terminal ($V_B$) which connects to the gate of an output transistor B0 516.

The output transistor A0 514 is used for pull up, and the output transistor B0 516 is used for pull down. When the input voltage (Vin) is higher than the output voltage (Vout), differential amplifier A 510 turns the output transistor. A0 514 on, so that through the transistor A0 514 flows the current ($I_{A0}$) to charge the output capacitative load. Similarly, when the input voltage (Vin) is lower than the output voltage (Vout), differential amplifier B 512 turns on the output transistor B0 516, so that through transistor B0 516 flows the current ($I_{B0}$) to discharge the output capacitative load. The current output ($I_{out}$) by the dead-zone amplifier 502 is equal to the current flowing through the transistor A0 514 ($I_{A0}$) minus the current flowing through the transistor B0 516 ($I_{B0}$).

FIG. 5B is a diagram of the differential amplifier A 510 in a preferred embodiment of the present invention. The differential amplifier A 510 includes four transistors, denoted A1 520, A2 522, A3 524, and A4 526, and a current source $I_A$ 528. Transistors A1 520 and A2 522 form a differential pair, and transistors A3 524 and A4 526 form a current mirror. The dimensions (width, length) of the channels of the transistors are as follows: A1 520 ($W_P$, $L_P$), A2 522 ($W_P+\Delta W_P$, $L_P-\Delta L_P$), A3 524 ($W_A$, $L_A$), and A4 526 ($W_A-\Delta W_A$, $L_A+\Delta L_A$).

FIG. 5C is a diagram of the differential amplifier B 512 in a preferred embodiment of the present invention. Similarly to the differential amplifier A 510 shown in FIG. 5B, the differential amplifier B 512 includes four transistors, denoted B1 530, B2 532, B3 534, and B4 536, and a current source $I_B$ 538. Transistors B1 530 and B2 532 form a differential pair, and transistors B3 534 and B4 536 form a current mirror. The dimensions (width, length) of the channels of the transistors are as follows: B1 530 ($W_N$, $L_N$), B2 532 ($W_N+\Delta W_N$, $L_N-\Delta L_N$), B3 534 ($W_B$, $L_B$), and B4 536 ($W_B-\Delta W_B$, $L_B+\Delta LB$).

A skewness is introduced in order to achieve the feature that current ($I_{out}$) at the output (out) of the dead-zone amplifier 502 is insignificant (i.e. the dead-zone amplifier 502 shuts off) when $V_{out}$ is relatively close to $V_{in}$. The ways the skewness may be introduced include the following:

(1) Increase the conductivity of one side of the current mirrors by making the transistors A2 522 and B2 532 have larger channel width ($\Delta W_P>0$, $\Delta W_N>0$) or shorter channel length ($\Delta L_P>0$, $\Delta L_N>0$) than the transistors A1 520 and B1 530, respectively.

(2) Decrease the conductivity of one side of the differential pairs by making the transistors A4 526 and B4 536 have smaller channel width ($\Delta W_A>0$, $\Delta W_B>0$) or longer channel length ($\Delta L_A>0$, $\Delta L_B>0$) than the transistors A3 524 and B3 534, respectively.

(3) Any combination of (1) and (2).

FIG. 5D is a graph showing the results of a simulation of an amplifier with no asymmetry (i.e. $\Delta W_P=\Delta W_N=\Delta L_P=\Delta L_N=\Delta W_A=\Delta W_B=\Delta L_A=\Delta L_B=0$) and hence no deadzone. The amplifier was simulated using HSPICE, a version of an integrated circuit emulation program which is well known in the, pertinent art. The horizontal axis of the graph gives $V_{in}$ (in volts). For this simulation, $V_{out}$ was set to the constant voltage of 4.50 volts. Graphed vertically are the currents $I_{A0}$ and $I_{B0}$. Recall that $Iout=I_{A0}-I_{B0}$, such that a positive $I_{A0}$ charges the output capacitance, and a positive $I_{B0}$ discharges the output capacitance.

As shown in FIG. 5D, $I_{A0}$ is zero when $V_{in}$ is less than $V_{out}$ and becomes curves up positively for $V_{in}$ greater than $V_{out}$. On the other hand, $I_{B0}$ is zero when $V_{in}$ is greater than $V_{out}$ and curves up positively for $V_{in}$ less than $V_{out}$. Since there is no significant range of $V_{in}$ where $I_{out}=0$, there is no dead zone in FIG. 5D.

FIG. 5E is a graph which shows the results of a simulation of an amplifier with 5% asymmetry (i.e. $\Delta W_P=5\%W_P$, $\Delta W_N=5\%W_N$, $\Delta L_P=\Delta L_N=\Delta W_A=\Delta W_B=\Delta L_A=\Delta L_B=0$). This graph illustrates the narrow dead zone created by a small amount of asymmetry.

As shown in FIG. 5E, there is a range of $V_{in}$ (roughly centered at $V_{out}$) in which both $I_{A0}$ and $I_{B0}$ are near zero, and hence in which $I_{out}$ is near zero. This range is the "dead zone." Outside of the dead zone, either $I_{A0}$ or $I_{B0}$ increase dramatically, and hence the magnitude of $I_{out}$ increases dramatically. For $V_{in}$ lower than the dead zone, $I_{B0}$ increases dramatically. For Vin higher than the dead zone, $I_{A0}$ increases dramatically.

FIG. 5F is a graph which shows the results of a simulation of an amplifier with 20% asymmetry (i.e. $\Delta W_P=20\%W_P$, $\Delta W_N=20\%W_N$, $\Delta L_P=\Delta L_N=\Delta W_A=\Delta W_B=\Delta L_A=\Delta L_B=0$). This graph illustrates the widening of the dead zone as asymmetry is increased.

As shown in FIG. 5F, in comparison with FIG. 5E, there is a larger range of Vin (again roughly centered at $V_{out}$) in which both $I_{A0}$ and $I_{B0}$ are near zero, and hence $I_{out}$ is near zero. This larger range forms a larger dead zone.

FIG. 5G is a graph showing the results of a simulation of an amplifier with 20% asymmetry in differential amplifier A 510 (i.e. $\Delta W_P=20\%W_P$, $\Delta L_P=\Delta W_A=\Delta L_A=0$) and 15% asymmetry in differential amplifier B 512 (i.e. $\Delta W_N=15\%W_N$, $\Delta L_N=\Delta W_B=\Delta L_B=0$). This graph illustrates that the amount of asymmetry in the two differential amplifiers A 510 and B 512 may be set independently to achieve the desired dead-zone characteristic.

As shown in FIG. 5G, in comparison with FIG. 5F, the substantially non-zero portion of the $I_{B0}$ curve has shifted to the right (to higher $V_{in}$), reducing the left side of the dead zone to a narrower range in $V_{in}$. By thus adjusting the configuration of the circuit, the desired dead-zone characteristic may be achieved.

FIG. 5H is a transistor level diagram of a dead-zone amplifier 502 with the dead-zone characteristic shown in FIG. 5G in a preferred embodiment of the present invention. In particular, the transistors in the amplifier 502 have the following dimensions:

$W_P=20\ \mu m$, $\Delta W_P=4\ \mu m=20\%W_P$,
$L_P=1.6\ \mu m, \Delta L_P=0$,
$W_A=8\ \mu m$, $\Delta W_A=0$,
$L_A=1.6$ m, $\Delta L_A=0$,
$W_N=8\ \mu m, \Delta W_N=1.2\ \mu m=15\%W_N$,
$L_N=1.6\ \mu m, \Delta L_N=0$,
$W_B=20\ \mu m$, $\Delta W_B=0$,
$L_B=1.6\ \mu m$, $\Delta L_B=0$, An additional advantage of having a dead-zone characteristic is that effects due to an offset voltage can be reduced. Such amplifiers typically have some offset voltage which results when the device sizes or other parameters do not match exactly in production. The amount of offset voltage can reach a few millivolts. Without a dead zone, the amplifier would drive $V_{out}$ towards $V_{in}$ plus the offset voltage, resulting in an error in output level and potentially additional power consumption. On the other hand, with a sufficiently large dead zone, the amplifier turns off before driving the output level to the wrong voltage.

FIG. 5I is a diagram of an auto-stop buffer system 550 which includes multiple auto-stop buffer circuits 500, in a preferred embodiment of the present invention. The auto-stop buffer system 550 is similar to the timed buffer system 450, but the timed buffer circuits 400 are replaced by the auto-stop buffer circuits 500 which require less control and timing circuitry.

FIG. 6 is a diagram of a second and alternate auto-stop buffer circuit 600, including a dead-zone buffer 502 and a degenerating resistor 602, in an alternate embodiment of the present invention. The input of the circuit ($V_{in}$) goes into the noninverting input terminal (+) of the dead-zone amplifier 502. The output of the circuit ($V_{out}$) comes from the output terminal (out) of the dead-zone amplifier 502. The output of the circuit 600 ($V_{out}$) is also connected to the inverting input terminal (−) of the dead-zone amplifier 502.

The configuration described so far is similar to a voltage follower configuration of a conventional operational amplifier. However, as described above, there are differences between the dead-zone amplifier 502 and a conventional operational amplifier. In particular, the dead-zone amplifier 502 is designed so that it shuts off automatically if its output voltage ($V_{out}$) is relatively close to its input voltage ($V_{in}$).

In addition, the first auto-stop buffer circuit 500 includes the degenerating resistor 602 which connects the noninverting (+) and inverting (-) terminals of the dead-zone amplifier 502 in place of a predrive switch 504. When the auto-stop buffer 502 shuts off, the resistor string DAC 102 drives the output voltage ($V_{out}$) to its final value via the degenerating resistor 602.

FIG. 7 is a diagram of a first column driver architecture 700 in an alternate embodiment of the present invention. Like in the basic column driver structure 100 shown in FIG. 1, the first architecture 700 has a resistor string DAC 102 which receives several analog reference voltages (e.g., VS0, VS1, VS2, . . . , VS7, VS8) and interpolates between them to generate N analog voltage levels. However, in the first architecture 700, the resistor string DAC 102 outputs the N analog voltage levels via two sets of N lines (rather than only one set of N lines in the basic structure 100).

The first set of N lines transmits the N analog voltage levels to an array of N buffers 702. The N buffer array 702 boosts the current drive capability of the N analog voltage levels and drives a first decoder (N:1 multiplexer) 704. Under control of the shift register 106, the first decoder 704 selects one of the N voltages and outputs the selected voltage to a first transistor switch 706. Since the buffers have inherent offset, the voltage level might be different from the level given by the resistor-string DAC.

The second set of N lines transmits the N analog voltage levels directly to a second decoder (N:1 multiplexer) 708. Under control of the shift register 106, the second decoder 708 selects one of the N (low-power) analog voltage levels and outputs the selected precision voltage to a second transistor switch 710. The precision voltage selected by the second decoder 708 differs in value from the voltage selected by the first decoder 704 by a few millivolts.

A predrive signal, like the one shown in FIG. 4A for the timed buffer circuit 400, is applied to the predriven decoder structure 700. During the predrive stage (when the predrive signal is high), the first transistor switch 706 is turned on so that the high-power voltage selected by the first decoder 704 drives a column of the LCD panel 202 to close to a final value. Right after the precision drive stage (when the predrive signal is low), the second transistor switch 710 is turned on so that the low-power voltage selected by the second decoder 708 drives the column to the final value.

Of course, the first column driver architecture 700 shown in FIG. 7 drives only a single column of the LCD panel 202. Driving the entire panel 202 requires for each column that there be two decoders (704 and 708) and predrive/precision drive switching circuitry including two transistor switches (706 and 710). Furthermore, additional control and timing circuitry is needed to control the switching circuitry.

Thus, the first architecture 700 uses only one buffer per analog voltage (gray-scale) level, instead of one buffer per column, to drive the LCD panel 202. However, such a system requires two decoders per column electrode.

FIG. 8 is a diagram of a second column driver architecture 800 in an alternate embodiment of the present invention.

Like in the basic column driver structure 100 shown in FIG. 1, the second architecture 800 has a resistor string DAC 102 which receives several analog reference voltages (e.g., VS0, VS1, VS2, . . . , VS7, VS8) and interpolates between them to generate N analog voltage levels. However, in the second architecture 800, the resistor string DAC 102 outputs the N analog voltage levels via two sets of N lines (rather than only one set of N lines in the basic structure 100).

The first set of N lines transmits the N analog voltage levels to an array 802 of N dead-zone amplifiers 502. In particular, each of the N lines connect to the noninverting (+) input terminal of a dead-zone amplifier 502. The inverting (−) input terminal of each dead-zone amplifier 502 is connected to its output terminal (out). The array 802 of N dead-zone amplifiers 502 boosts the current drive capability of the N analog voltage levels and drives a first decoder (N:1 multiplexer) 804 when the difference between input and output voltages is relatively substantial. Under control of the shift register 106, the first decoder 804 selects one of the N voltages and outputs the selected voltage to a single column electrode in the LCD panel 202.

The second set of N lines transmits the N analog voltage levels directly to a second decoder (N:1 multiplexer) 806. Under control of the shift register 106, the second decoder 806 selects one of the N (precision) analog voltage levels and outputs the selected precision voltage to a transistor switch 808. The precision voltage selected by the second decoder 806 differs in value from the voltage selected by the first decoder 804 by a few millivolts which corresponds to the combined effect of dead zone and offset of the amplifier.

Timing and control circuitry 810 controls the transistor switch 808 such that the switch 808 is on when the dead-zone amplifier 502 supporting the selected voltage shuts itself down.

Of course, like the first column architecture 700 shown in FIG. 7, the second column driver architecture 800 shown in FIG. 8 drives only a single column of the LCD panel 202. Driving the entire panel 202 requires for each column driven that there be two decoders (804 and 806) and a switch 808.

Thus, like the first architecture 700, the second architecture 800 uses only one buffer per analog voltage (gray-scale) level, instead of one buffer per column, to drive the LCD panel 202. However, such a system requires two decoders per column electrode.

FIG. 9 is a diagram of a third column driver architecture 900 in an alternate embodiment of the present invention. Like in the basic column driver structure 100 shown in FIG. 1, the resistor string DAC 102 receives several analog reference voltages and interpolates between them to generate N analog voltage levels and outputs the N analog voltage levels via only one set of N lines. The set of N lines leads to an array 902 of N buffer circuits.

The buffer circuits in the array 902 may be either the timed buffer circuits 400 shown in FIG. 4, the first auto-stop buffer circuits 500 shown in FIG. 5, or the second auto-stop buffer circuits 600 shown in FIG. 6. Each of the N buffer circuits in the array 902 receives as input one of the analog voltage levels. The outputs of the array 902 go to a decoder (N:1 multiplexer) 904. The decoder 904 selects the output of one of the N buffer circuits. The selected output drives a single column of the LCD panel 202.

Like the first 700 and second 800 architectures, the third architecture 900 shown in FIG. 9 drives only a single column of the LCD panel 202. Driving the entire panel 202 requires that a decoder 904 be used for each column.

Thus, the third architecture 900 uses only one buffer per analog voltage level and requires only one decoder per column.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention. For example, the differential amplifier A 510 is a class C amplifier as shown in FIG. 5B. However, it can be modified to become class A amplifier if it was symmetric, except that the width of transistor A2 was less than the width of transistor A1 (or the length of transistor A2 was greater than the length of transistor A1, or the width of transistor A4 was greater than the width of transistor A3, or the length of transistor A4 was less than the length of transistor A3, or any combination thereof). The differential amplifier B 512 may be similarly modified from a class C amplifier to a class A amplifier. The classification of amplifiers as class A, B, or C are well known in the art.

What is claimed is:

1. A system for driving a column of an active matrix display comprising:

a resistor string digital-to-analog converter (DAC) for receiving a plurality of analog reference levels and generating multiple voltages by interpolation;

a decoder for receiving the multiple voltages and selecting a single voltage from the multiple voltages; and an auto-stop buffer circuit for receiving the single voltage selected by the decoder and driving an output voltage toward the single voltage, wherein the output voltage is driven onto the column of the active matrix display;

wherein the auto-stop buffer circuit includes a dead-zone amplifier;

wherein the dead-zone amplifier actively drives the output voltage closer to the single voltage when there is a relatively substantial difference between the single voltage and the output voltage;

wherein the dead-zone amplifier conserves power by automatically ceasing to actively drive the output voltage toward the single voltage when there is an insubstantial difference between the single voltage and the output voltage; and wherein the auto-stop buffer circuit further includes a passive conduit by way of which the output voltage is driven directly by the single voltage when the difference between the single voltage and the output voltage is insubstantial.

2. The system in claim 1, wherein the dead-zone amplifier comprises an asymmetrical differential amplifier.

3. The system of claim 1, wherein the auto-stop buffer circuit comprises:

a noninverting input terminal of the dead-zone amplifier;

an inverting input terminal of the dead-zone amplifier;

an output terminal of the dead-zone amplifier which is connected to the inverting input terminal;

a circuit input which is connected to the noninverting input terminal and which receives the single voltage;

a circuit output which is connected to the output terminal and which outputs the output voltage; and a switch between the circuit input and the circuit output which is controlled by timing and control circuitry.

4. The system of claim 3, wherein the switch closes and acts as a passive conduit, through which the output voltage is driven directly by the single voltage when the difference between the single voltage and the output voltage is insubstantial.

5. The system of claim 2, wherein the auto-stop buffer circuit comprises:

a noninverting input terminal of the dead-zone amplifier;

an inverting input terminal of the dead-zone amplifier;

an output terminal of the dead-zone amplifier which is connected to the inverting input terminal;

a circuit input which is connected to the noninverting input terminal and which receives the single voltage;

a circuit output which is connected to the output terminal and which outputs the output voltage; and a resistor between the noninverting input terminal and the inverting input terminal.

6. The system of claim 5, wherein the resistor acts as the passive conduit through which the output voltage is driven directly by the single voltage when the difference between the single voltage and the output voltage is insubstantial.

7. A system for driving a column of an active matrix display comprising:

a resistor string digital-to-analog converter (DAC) for receiving a plurality of analog reference levels and generating multiple voltages by interpolation;

an array of buffers connected to the resistor string DAC a first decoder connected to the array of buffers for selecting a first single voltage from among multiple voltages driven at high power;

a second decoder connected to the resistor string DAC for selecting a second single voltage from among the multiple voltages driven at low power;

a first switch connected to the first decoder for transmitting the first single voltage;

a second switch connected to the second decoder for transmitting the second single voltage; and a predrive signal for turning on the first switch and turning off the second switch during a first period of time, and for turning off the first switch and turning on the second switch during a second period of time.

8. A system for driving a column of an active matrix display comprising:

a resistor string digital-to-analog converter (DAC) for receiving a plurality of analog reference levels and generating multiple voltages by interpolation;

an array of dead-zone amplifiers connected to the resistor string DAC;

a first decoder connected to the array for selecting a first single voltage from among multiple voltages driven at high power;

a second decoder connected to the resistor string DAC for selecting a second single voltage from among the multiple voltages driven at low power; and a switch connected to the second decoder for transmitting the second single voltage.

* * * * *